US010691042B2

(12) United States Patent
Ogasawara et al.

(10) Patent No.: US 10,691,042 B2
(45) Date of Patent: Jun. 23, 2020

(54) IMAGE FORMING APPARATUS

(71) Applicant: TOSHIBA TEC KABUSHIKI KAISHA, Tokyo (JP)

(72) Inventors: Masato Ogasawara, Katsushika Tokyo (JP); Shigeru Fujiwara, Yokohama Kanagawa (JP); Mitsutoshi Watanabe, Tagata Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/353,858

(22) Filed: Mar. 14, 2019

(65) Prior Publication Data

US 2020/0019086 A1 Jan. 16, 2020

(30) Foreign Application Priority Data

Jul. 13, 2018 (JP) ..... 2018-133527

(51) Int. Cl.
*G03G 15/09* (2006.01)
*G03G 15/08* (2006.01)

(52) U.S. Cl.
CPC ..... *G03G 15/0812* (2013.01); *G03G 15/0921* (2013.01)

(58) Field of Classification Search
CPC ..... G03G 15/0812; G03G 15/09; G03G 15/0921; G03G 15/081; G03G 15/0808
USPC ..... 399/274
See application file for complete search history.

(56) References Cited

U.S. PATENT DOCUMENTS 3,648,656 A * 3/1972 Ogawa ..... G03G 15/09 399/234
5,953,563 A * 9/1999 Yamaguchi ..... G03G 15/09 399/119
2006/0046177 A1* 3/2006 Daifuku ..... C07F 15/045 430/108.21
2007/0014594 A1* 1/2007 Bessette ..... G03G 15/0812 399/284
2014/0169839 A1* 6/2014 Nakayama ..... G03G 15/0921 399/274

(Continued)

FOREIGN PATENT DOCUMENTS

CN 206115145 U 4/2017
JP 01068782 * 3/1989 ..... G03G 21/00

*Primary Examiner* — Walter L Lindsay, Jr.
*Assistant Examiner* — Frederick Wenderoth
(74) *Attorney, Agent, or Firm* — Kim & Stewart LLP

(57) ABSTRACT

A developing device includes a housing, a developing roller, and a blade. The housing includes a developer chamber and an opening. The developing roller is disposed in the developer chamber, such that a part of the developing roller in a rotational direction thereof is exposed to an outside of the opening. The developer roller includes a sleeve rotatable around a shaft and a magnetic element. The magnetic element has a magnetic polarity opposite to that of a developer and is disposed at an entrance rotational position of the developer roller at which a sleeve region of the sleeve goes into the developer chamber from the outside of the opening. The blade is positioned near a surface of the sleeve to regulate a thickness of the developer on the surface of the sleeve. The thickness of the developer regulated on the sleeve region at the entrance rotational position by the blade is equal to or greater than 0.6 mm and equal to or less than 1.4 mm.

19 Claims, 15 Drawing Sheets

(56) References Cited

U.S. PATENT DOCUMENTS

| | | | |
|---|---|---|---|
| 2019/0018336 | A1 | 1/2019 | Ogasawara et al. |
| 2019/0018345 | A1 | 1/2019 | Ogasawara et al. |
| 2019/0018346 | A1 | 1/2019 | Ogasawara et al. |

* cited by examiner

IMAGE FORMING APPARATUS

CROSS-REFERENCE TO RELATED APPLICATION

This application is based upon and claims the benefit of priority from Japanese Patent Application No. 2018-133527, filed Jul. 13, 2018, the entire contents of which are incorporated herein by reference.

FIELD

Embodiments described herein relate to an image forming apparatus.

BACKGROUND

There are image forming apparatuses such as a multi-function peripheral (hereinafter referred to as "MFP") and a printer. An image forming apparatus of one type includes a developing device which accommodates a developer. The developing device includes a developing roller. When air enters the inside of the developing device with the rotation of the developing roller, the pressure in the developing device may increase. When the pressure in the developing device increases, air containing toner in the developing device may spout out from the developing device. When air containing toner spouts out from the developing device, the toner may scatter outside the developing device, and a functional component such as a charger may be contaminated.

DETAILED DESCRIPTION

Figure 1:
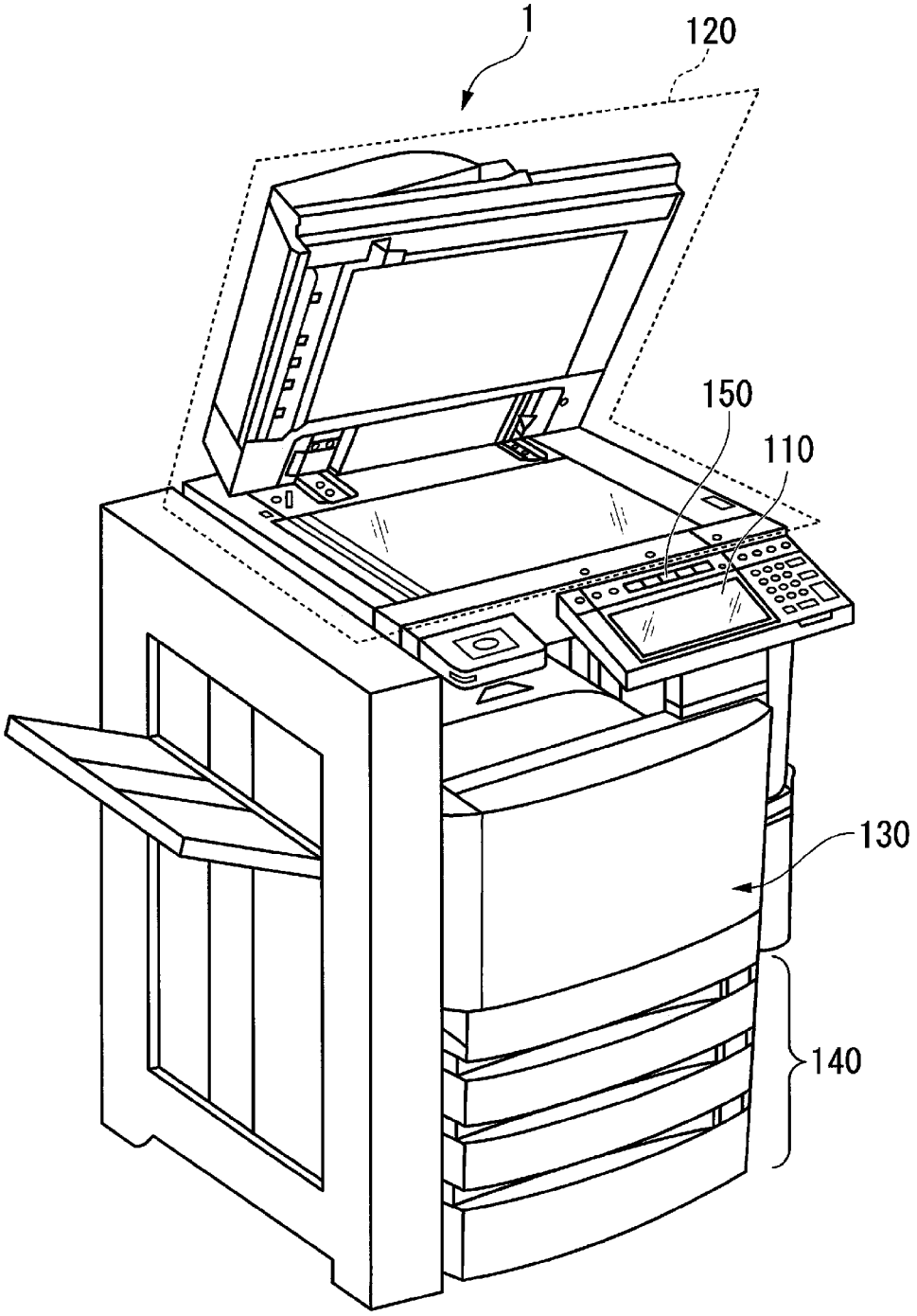
FIG. 1 illustrates an external view of an example of an image forming apparatus according to an embodiment.

Embodiments provide a developing device and an image forming apparatus capable of suppressing scattering of a toner outside the developing device.

An image forming apparatus of an embodiment includes a developing device. The developing device includes a housing, a developing roller, and a blade. The housing includes a developer chamber and an opening. The developing roller is disposed in the developer chamber, such that a part of the developing roller in a rotational direction thereof is exposed to an outside of the opening. The developer roller includes a shaft, a sleeve rotatable around the shaft, and a magnetic element between the shaft and the sleeve. The magnetic element has a magnetic polarity opposite to a magnetic polarity of a developer and is disposed at an entrance rotational position of the developer roller at which a sleeve region of the sleeve goes into the developer chamber from the outside of the opening. The blade is positioned near a surface of the sleeve to regulate a thickness of the developer on the surface of the sleeve. The thickness of the developer regulated on the sleeve region at the entrance rotational position by the blade is equal to or greater than 0.6 mm and equal to or less than 1.4 mm.

Hereinafter, an image forming apparatus of an embodiment will be described with reference to the drawings. In the respective drawings, the same components are denoted by the same reference numerals.

FIG. 1 illustrates an external view of an example of an image forming apparatus 1 according to an embodiment. For example, the image forming apparatus 1 is a multi-function peripheral (MFP). The image forming apparatus 1 reads an image formed on a sheet-like recording medium (hereinafter referred to as "sheet") such as paper and generates digital data (image file). The image forming apparatus 1 forms an image on a sheet using toner based on the digital data.

The image forming apparatus 1 includes a display portion 110, an image reading portion 120, an image forming portion 130, and a sheet tray 140.

The display portion 110 serves as an output interface and performs display of texts or images. The display portion 110 also acts as an input interface and receives an instruction from a user. For example, the display portion 110 is a touch-panel-type liquid crystal display.

For example, the image reading portion 120 is a color scanner. Examples of the color scanner include a contact image sensor (CIS) and a charge coupled device (CCD). The image reading portion 120 reads an image formed on a sheet using a sensor and generates digital data.

The image forming portion 130 forms an image on a sheet using toner. The image forming portion 130 forms an image based on image data read by the image reading portion 120 or image data received from an external device. For example, the image formed on a sheet is an output image called "hard copy", "printout", or the like.

The sheet tray 140 supplies a sheet to be used for image output to the image forming portion 130.

Figure 2:
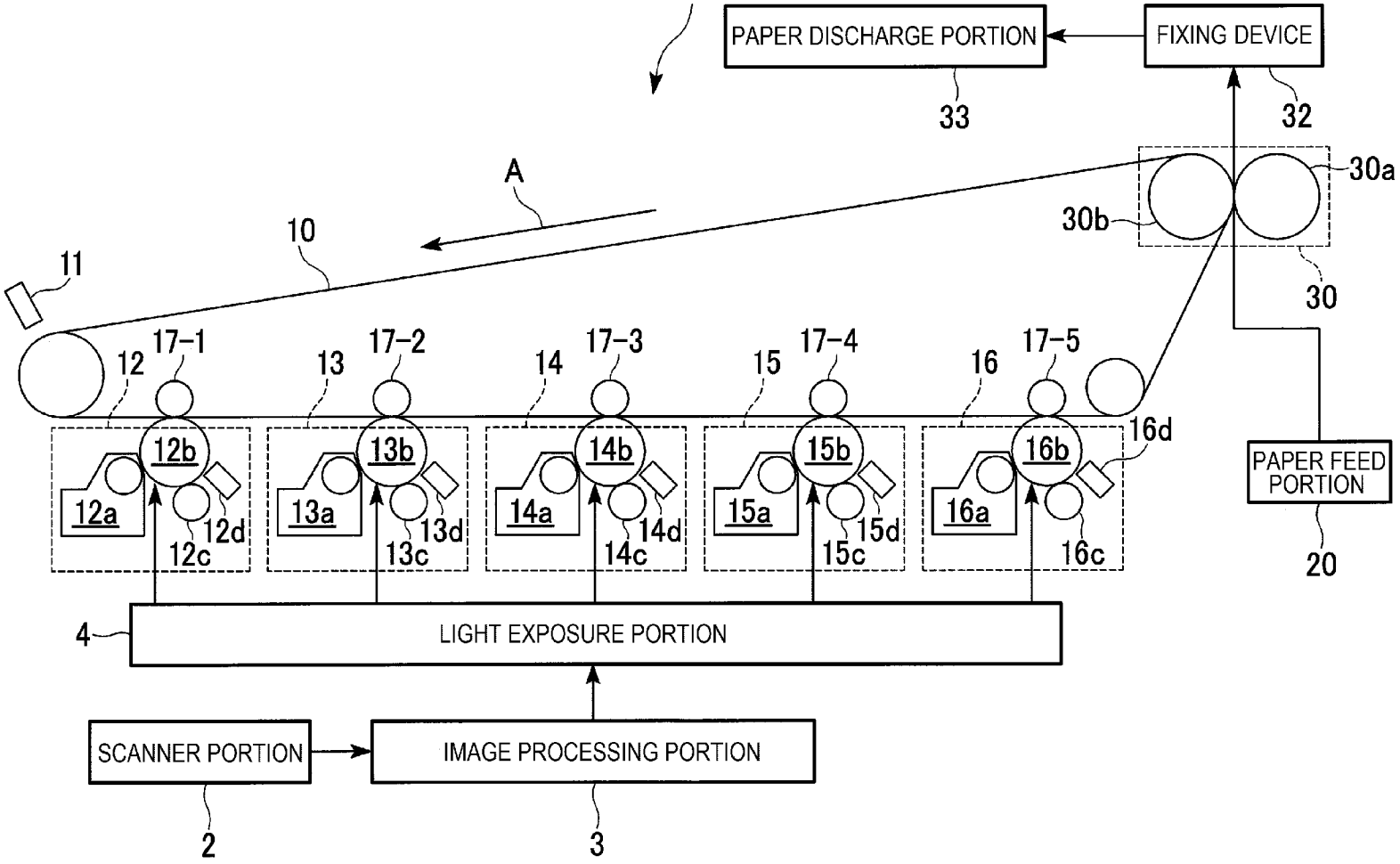
FIG. 2 is a diagram showing an example of a schematic structure of the image forming apparatus according to the embodiment.

FIG. 2 is a diagram showing an example of a schematic structure of the image forming apparatus 1. The image forming apparatus 1 is an electrophotographic image forming apparatus. The image forming apparatus 1 is a quintuple tandem-type image forming apparatus.

Examples of the toner include decolorable toner, non-decolorable toner (normal toner), and decorative toner. The decolorable toner has a property of decoloring by external stimulation. The "decoloring" means that an image formed with a color (including not only a chromatic color, but also an achromatic color such as white or black) which is different from the base color of a sheet is made visually invisible. For example, the external stimulation is temperature, light with a specific wavelength, or pressure. In the embodiment, the decolorable toner is decolored when the temperature reaches a specific decoloring temperature or higher. The decolorable toner is colored when the temperature reaches a specific restoring temperature or lower after the toner is decolored.

As the decolorable toner, any toner may be used as long as the toner has the above-mentioned property. For example, a colorant of the decolorable toner may be a leuco dye. In the decolorable toner, a color developing agent, a decoloring agent, a color change temperature regulator, and the like may be appropriately combined.

Further, the fixing temperature of the decolorable toner is lower than the fixing temperature of a non-decolorable toner. Here, the fixing temperature of the decolorable toner corresponds to the temperature of a heat roller 40 in a decolorable toner mode (described below). The fixing temperature of the non-decolorable toner corresponds to the temperature of the heat roller 40 in a monochrome toner mode or a color toner mode (described below).

The fixing temperature of the decolorable toner is lower than the decoloring temperature of the decolorable toner. Here, the decoloring temperature of the decolorable toner corresponds to the temperature of the heat roller 40 in a decoloring mode (described below).

The image forming apparatus 1 includes a scanner portion 2, an image processing portion 3, a light exposure portion 4, an intermediate transfer body 10, a cleaning blade 11, image forming portions 12 to 16, primary transfer rollers 17-1 to 17-5, a paper feed portion 20, a secondary transfer portion 30, a fixing device 32, a paper discharge portion 33, and a control portion (not shown). Hereinafter, when the primary transfer rollers are not distinguished from one another, the primary transfer rollers are simply denoted by "primary transfer roller 17".

In the following description, the sheet is conveyed from the paper feed portion 20 to the paper discharge portion 33, and therefore, the paper feed portion 20 side is referred to as "upstream side" with respect to a sheet conveying direction Vs, and the paper discharge portion 33 side is referred to as "downstream side" with respect to the sheet conveying direction Vs.

The transfer in the image forming apparatus 1 includes a first transfer step and a second transfer step. In the first transfer step, the primary transfer roller 17 transfers an image of toner on the photoconductive drum of each image forming portion to the intermediate transfer body 10. In the second transfer step, the secondary transfer portion 30 transfers the images of the toner of the respective colors stacked on the intermediate transfer body 10 to a sheet.

The scanner portion 2 reads the image formed on the sheet to be scanned. For example, the scanner portion 2 reads the image on the sheet and generates image data of three primary colors of red (R), green (G), and blue (B). The scanner portion 2 outputs the generated image data to the image processing portion 3.

The image processing portion 3 converts the image data into color signals of the respective colors. For example, the image processing portion 3 converts the image data into image data (color signals) of four colors including yellow (Y), magenta (M), cyan (C), and black (K). The image processing portion 3 controls the light exposure portion 4 based on the color signals of the respective colors.

The light exposure portion 4 irradiates the photoconductive drum of the image forming portion with light (exposed to light). The light exposure portion 4 includes an exposure light source such as a laser or an LED.

The intermediate transfer body 10 is an endless belt. The intermediate transfer body 10 rotates in the direction of the arrow A in FIG. 2. On the surface of the intermediate transfer body 10, a toner image is formed.

The cleaning blade 11 removes the toner adhered onto the intermediate transfer body 10. For example, the cleaning blade 11 is a plate-like member. For example, the cleaning blade 11 is made of a resin such as a urethane resin.

The image forming portions 12 to 16 form images using the toner of the respective colors (5 colors in the example shown in FIG. 2). The image forming portions 12 to 16 are aligned along the intermediate transfer body 10.

The primary transfer rollers 17 (17-1 to 17-5) are used when toner images formed by the respective image forming portions 12 to 16 are transferred to the intermediate transfer body 10.

The paper feed portion 20 feeds a sheet.

The secondary transfer portion 30 includes a secondary transfer roller 30*a* and a secondary transfer counter roller 30*b*. The secondary transfer portion 30 transfers the toner images formed on the intermediate transfer body 10 to a sheet.

In the secondary transfer portion 30, the intermediate transfer body 10 and the secondary transfer roller 30*a* are in contact with each other. To remove paper jams, the intermediate transfer body 10 and the secondary transfer roller 30*a* may be configured to be separable from each other.

The fixing device 32 fixes the toner image transferred onto the sheet by heating and pressing. The sheet having the image fixed by the fixing device 32 is discharged outside the apparatus from the paper discharge portion 33.

Next, the image forming portions 12 to 16 will be described. The image forming portions 12 to 15 accommodate the toner of the respective colors corresponding to the four colors for color printing, respectively. The four colors for color printing are colors of yellow (Y), magenta (M), cyan (C), and black (K). The toners of the four colors for color printing are non-decolorable toners. The image forming portion 16 accommodates decolorable toner. The image forming portions 12 to 15 and the image forming portion 16 have the same configuration although the toners to be accommodated are different. Therefore, the image forming portion 12 will be representatively described for the image forming portions 12 to 16, and the description of the other image forming portions 13 to 16 is omitted.

The image forming portion 12 includes a developing device 12*a*, a photoconductive drum 12*b*, a charger 12*c*, and a cleaning blade 12*d*.

The developing device 12*a* accommodates a developer. The developer includes toner. The developing device 12*a* cause the toner to adhere to the photoconductive drum 12*b*. For example, the toner is used as a one-component developer or a two-component developer by being combined with a carrier. For example, as the carrier, iron powder or polymer ferrite particles having a particle diameter of several tens of micrometers are used. In the embodiment, a two-component developer containing a nonmagnetic toner is used.

The photoconductive drum 12*b* is one specific example of an image carrying body (image carrying unit). The photoconductive drum 12*b* includes a photoconductive body (photoconductive region) on the outer peripheral face thereof. For example, the photoconductive body is an organic photoconductive body (OPC).

The charger 12*c* uniformly charges the surface of the photoconductive drum 12*b*.

The cleaning blade 12*d* removes the toner adhered onto the photoconductive drum 12*b*.

Next, the outline of the operation of the image forming portion 12 will be described.

The photoconductive drum 12*b* is charged to a given potential by the charger 12*c*. Subsequently, the photoconductive drum 12*b* is irradiated with light from the light exposure portion 14. By doing this, the potential of the region irradiated with light in the photoconductive drum 12*b* is changed. According to this change, an electrostatic latent image is formed on the surface of the photoconductive drum 12*b*. The electrostatic latent image on the surface of the photoconductive drum 12*b* is developed with the developer of the developing device 12*a*. That is, an image developed with the toner (hereinafter referred to as "developed image") is formed on the surface of the photoconductive drum 12*b*.

The developed image formed on the surface of the photoconductive drum 12*b* is transferred onto the intermediate transfer body 10 by the primary transfer roller 17-1 facing the photoconductive drum 12*b* (first transfer step).

Next, the first transfer step in the image forming apparatus 1 will be described. First, the primary transfer roller 17-1 facing the photoconductive drum 12*b* transfers the developed image on the photoconductive drum 12*b* to the intermediate transfer body 10. Subsequently, the primary transfer roller 17-2 facing a photoconductive drum 13*b* transfers the developed image on the photoconductive drum 13*b* to the intermediate transfer body 10. Such processing is also performed for photoconductive drums 14*b*, 15*b*, and 16*b*. At this time, the developed images on the respective photoconductive drums 12*b* to 16*b* are transferred to the intermediate transfer body 10 so as to be overlapped with one another. Therefore, the developed images by the toners of the respective colors are transferred in a stacked manner onto the intermediate transfer body 10 after passing through the image forming portion 16.

However, when image formation is performed using only the non-decolorable toners, the image forming portions 12 to 15 operate. By such an operation, the developed image using only the non-decolorable toner is formed on the intermediate transfer body 10. Further, when image formation is performed using only the decolorable toner, the image forming portion 16 operates. By such an operation, the developed image using only the decolorable toner is formed on the intermediate transfer body 10.

Next, the second transfer step will be described. To the secondary transfer counter roller 30*b*, a voltage (bias) is applied. Therefore, an electric field is generated between the secondary transfer counter roller 30*b* and the secondary transfer roller 30*a*. According to this electric field, the secondary transfer portion 30 transfers the developed image formed on the intermediate transfer body 10 to a sheet.

Next, the fixing device 32 will be described.

Figure 3:
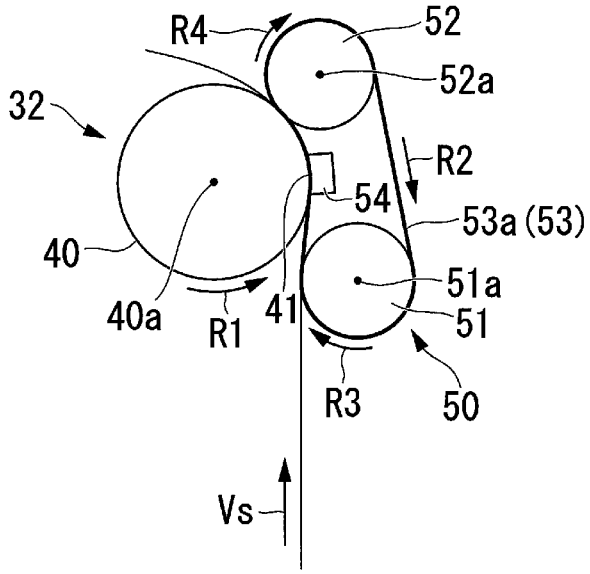
FIG. 3 is a diagram showing an example of a schematic structure of a fixing device according to an embodiment.

FIG. 3 is a diagram showing an example of a schematic structure of the fixing device 32.

As shown in FIG. 3, the fixing device 32 includes the heat roller 40 (heating portion) and a pressing unit 50.

First, the heat roller 40 serving as a heating unit will be described.

The heat roller 40 is disposed on the downstream side of the image forming portion 130 (specifically, the secondary transfer portion 30 shown in FIG. 2) in the sheet conveying direction Vs. The heat roller 40 is driven at the below-mentioned two target temperatures. The heat roller 40 is an endless fixing member. The heat roller 40 has a curved outer peripheral surface. That is, the heat roller 40 has a cylindrical shape. The heat roller 40 has a roller made of a metal. For example, the heat roller 40 has a resin layer made of a fluororesin or the like on the outer peripheral surface of a roller made of aluminum. The heat roller 40 can rotate around a first axis 40*a*. Here, the first axis 40*a* corresponds to a central axis (rotational axis) of the heat roller 40.

The fixing device 32 further includes a heat source (not shown) which heats the heat roller 40. For example, the heat source may be a resistive heating element such as a thermal head, a ceramic heater, a halogen lamp, an electromagnetic induction heating unit, or the like. As for the position of the heat source, the heat source may be disposed inside the heat roller 40 or may be disposed outside the heat roller 40.

Next, the pressing unit 50 will be described.

The pressing unit 50 includes a plurality of rollers 51 and 52, a belt 53 (rotating body), and a pressing pad 54 (pressing member).

The plurality of rollers 51 and 52 are disposed in the belt 53. In the present embodiment, the plurality of rollers 51 and 52 are a first roller 51 and a second roller 52. The plurality of rollers 51 and 52 may be the same roller or may be different rollers.

The plurality of rollers 51 and 52 can rotate around a plurality of rotational axes 51*a* and 52*a* parallel to the first axis 40*a*, respectively. The plurality of rollers 51 and 52 are disposed at positions so as to form a nip 41.

The first roller 51 is disposed on the upstream side of the second roller 52 in the sheet conveying direction Vs. The first roller 51 has a columnar shape. For example, the first roller 51 is a roller made of a metal such as iron. The first roller 51 can rotate around the first rotational axis 51*a* parallel to the first axis 40*a*. Here, the first rotational axis 51*a* corresponds to the central axis of the first roller 51.

The second roller 52 is disposed on the downstream side of the first roller 51 in the sheet conveying direction Vs. The second roller 52 has a columnar shape. For example, the second roller 52 is a roller made of a metal such as iron. The second roller 52 can rotate around the second rotational axis 52*a* parallel to the first axis 40*a*. Here, the second rotational axis 52*a* corresponds to the central axis of the second roller 52.

The belt 53 faces the heat roller 40. The belt 53 is stretched between the first roller 51 and the second roller 52. The belt 53 is endless.

The belt 53 includes abase layer 53*a* and a release layer (not shown). For example, the base layer 53*a* is formed of a polyimide resin (PI). For example, the release layer is formed of a fluororesin such as a tetrafluoroethylene-perfluoroalkyl vinyl ether copolymer (PFA). The layer structure of the belt 53 is not limited. The belt 53 includes a film-like member.

The pressing pad 54 has a rectangular parallelepiped shape. For example, the pressing pad 54 is formed of a heat-resistant resin material such as a polyphenylene sulfide resin (PPS), a liquid crystal polymer (LCP), or a phenolic resin (PF). The pressing pad 54 is disposed at a position facing the heat roller 40 across the belt 53. The pressing pad 54 is biased toward the heat roller 40 by a biasing member (not shown) such as a spring. The pressing pad 54 is in contact with the inner peripheral surface of the belt 53 and presses the belt 53 against the heat roller 40 to form the nip 41. That is, the nip 41 is formed between the belt 53 and the heat roller 40 by pressing the inner peripheral surface of the belt 53 toward the heat roller 40 side by the pressing pad 54.

Next, the rotation direction of the heat roller 40 or the like will be described.

The heat roller 40 rotates in the direction of the arrow R1 by being driven by a motor (not shown). That is, the heat roller 40 rotates in the direction of the arrow R1 independently of the pressing unit 50.

The belt 53 rotates in the direction of the arrow R2 in accordance with the heat roller 40. That is, the belt 53 rotates in accordance with the heat roller 40 by contacting the outer peripheral surface of the heat roller 40 which rotates in the direction of the arrow R1.

The first roller 51 rotates in the direction of the arrow R3 in accordance with the belt 53. The second roller 52 rotates in the direction of the arrow R4 in accordance with the belt 53. That is, the first roller 51 and the second roller 52 rotate in accordance with the belt 53 by coming into contact with the inner peripheral surface of the belt 53 which rotates in the direction of the arrow R2.

Next, the type of the image forming processing performed by the image forming apparatus 1 (see FIG. 1) according to the present embodiment will be described. The image forming apparatus 1 performs printing in the following three modes.

- monochrome toner mode: An image is formed with non-decolorable black monochrome toner.
- color toner mode: An image is formed with non-decolorable monochrome and color toners.
- decolorable toner mode: An image is formed with only decolorable toner.

Selection of the mode of the image formation can be made by operating the display portion 110 of the image forming apparatus 1 by a user.

In the monochrome toner mode, an image is formed by operating the image forming portion using the non-decolorable toner of black (K). The monochrome toner mode is a mode to be selected when a user desires to print a general monochrome image. For example, the mode is used when important materials and the like are desired to be stored without reusing paper.

In the color toner mode, an image is formed by operating four image forming portions using the respective non-decolorable toners of yellow (Y), magenta (M), cyan (C), and black (K). The color toner mode is a mode to be selected when a user desires to print a color image.

In the decolorable toner mode, an image is formed by operating only the image forming portion using the decolorable toner. The decolorable toner mode is a mode to be selected when paper having an image formed thereon is reused.

The fixing device 32 is controlled in a fixing mode and a decoloring mode. In the fixing mode, the toner image is fixed to the sheet. In the decoloring mode, the toner image is decolored from the sheet. In the decoloring mode, the temperature of the heat roller 40 is set higher than that in the fixing mode. That is, the control portion (not shown) allows the fixing device 32 to operate at two or more target temperatures. Specifically, two target temperatures of the fixing device 32 are stored in a memory (not shown). The control portion obtains the target temperature from the memory according to the selected mode, and allows the fixing device 32 to operate. The two target temperatures are a first temperature and a second temperature. Here, the first temperature is a temperature in the decoloring mode. The second temperature is a temperature in the fixing mode. That is, the second temperature is lower than the first temperature. As shown in FIG. 1, the display portion 110 includes a button 150 (operation portion) for switching the fixing device 32 from the decoloring mode to the fixing mode.

Next, the developing device 12*a* will be described.

Figure 4:
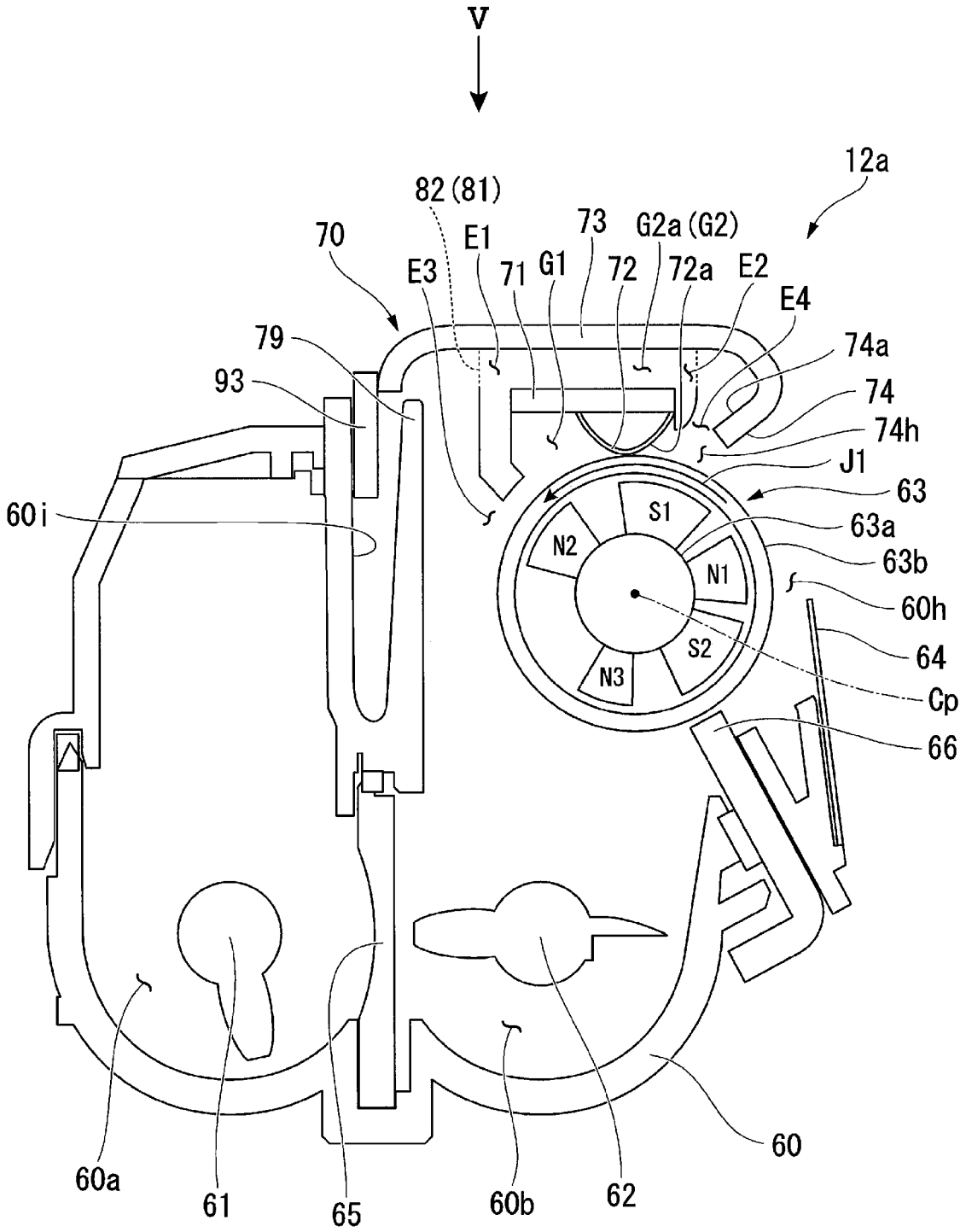
FIG. 4 illustrates a cross-sectional view of an example of a developing device according to an embodiment.

FIG. 4 illustrates a cross-sectional view of an example of the developing device 12*a*. In FIG. 4, cross-hatching is omitted.

As shown in FIG. 4, the developing device 12*a* includes a housing 60, a first mixer 61, a second mixer 62, a developing roller 63, a shield roller 63, a gap forming member 71, a shield member 72, and a guide portion 74.

The housing 60 accommodates a developer. The developer is composed of a carrier which is a magnetic material and toner as a coloring material. Inside the housing 60, the first mixer 61 and the second mixer 62 are disposed. On the side facing the photoconductive drum 12*b* (see FIG. 2) in the housing 60, an opening portion 60*h* for exposing a portion of the developing roller 63 is formed. In this embodiment, the housing 60 constitutes the developing device 12*a*, but may include a frame as the image forming apparatus 1 other than the developing device 12*a*. Further, the housing 60 and the gap forming member 71 may be integrally molded or formed as separate members.

Figure 5:
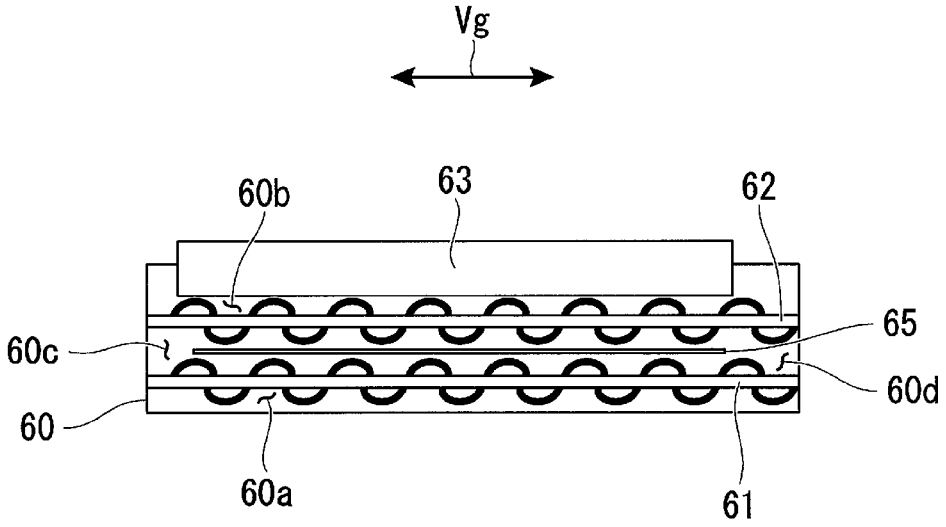
FIG. 5 illustrates a transparent view of the developing device in the direction of the arrow V in FIG. 4.

FIG. 5 illustrates a transparent plan view of the developing device 12*a* in the direction of the arrow V in FIG. 4. In FIG. 5, illustration of the gap forming member 71, the shield member 72, and the like is omitted.

As shown in FIG. 5, the first mixer 61 and the second mixer 62 are disposed parallel to each other. The first mixer 61 functions as a developer stirring portion that stirs the developer. The second mixer 62 functions as a developer supply portion that supplies the developer.

In the housing 60, a first chamber 60*a* in which the first mixer 61 is disposed is formed. In the housing 60, a second chamber 60*b* in which the second mixer 62 is disposed is formed. In the housing 60, a partition 65 which divides the first chamber 60*a* from the second chamber 60*b* is provided. The first chamber 60*a* and the second chamber 60*b* are adjacent to each other across the partition 65. In the housing 60, on both sides in the rotational axial direction Vg of the developing roller 63, side openings 60*c* and 60*d* for allowing the developer to circulate between the first chamber 60*a* and the second chamber 60*b* are formed. Hereinafter, the rotational axial direction Vg of the developing roller 63 is also referred to as "roller axial direction Vg".

As shown in FIG. 4, the developing roller 63 is provided rotatably in the housing 60. The developing roller 63 carries the developer by the magnetic force of the magnetic material. The developing roller 63 faces the photoconductive drum 12*b* (see FIG. 2) through the opening portion 60*h*. The developing roller 63 is disposed on the second chamber 60*b* side.

The developing roller 63 includes a shaft portion 63*a*, a plurality of magnetic pole portions N1, S1, N2, N3, and S2, and a sleeve portion 63*b*.

The shaft portion 63*a* extends in the roller axial direction Vg (see FIG. 5). The both end portions of the shaft portion 63*a* are fixed to the housing 60.

The plurality of magnetic pole portions N1, S1, N2, N3, and S2 are fixed to the shaft portion 63*a*. The plurality of magnetic pole portions N1, S1, N2, N3, and S2 are fixed at predetermined positions spaced apart from one another in the circumferential direction of the shaft portion 63*a*. For example, the plurality of magnetic pole portions N1, S1, N2, N3, and S2 are magnets.

The plurality of magnetic pole portions N1, S1, N2, N3, and S2 are a developing pole N1, a first conveying pole S1, a separating pole N2, a holding pole N3, and a second conveying pole S2. The developing pole N1 faces the photoconductive drum 12*b* (see FIG. 2) across the sleeve 63*b* so that the developer carried on the developing roller 63 is brought closer to the photoconductive drum 12*b*. The plurality of magnetic pole portions N1, S1, N2, N3, and S2 are disposed in the order of the first conveying pole S1, the separating pole N2, the holding pole N3, and the second conveying pole S2 downstream in the rotation direction J1 of the developing roller 63 from the developing pole N1. Hereinafter, the rotation direction J1 of the developing roller 63 is also referred to as "roller rotation direction J1". The developing pole N1, the separating pole N2, and the holding pole N3 are N poles. The first conveying pole S1 and the second conveying pole S2 are S poles.

The first conveying pole S1 is an intra-housing most upstream magnetic pole portion located on the most upstream side in the roller rotation direction J1 inside the housing 60. The first conveying pole S1 is located on the downstream side in the roller rotation direction J1 with respect to the position at which the developing roller 63 faces the photoconductive drum 12*b* (see FIG. 2) and on the most upstream side in the roller rotation direction J1 inside the housing 60.

The sleeve 63*b* has a cylindrical shape including the shaft portion 63*a* and the plurality of magnetic pole portions N1, S1, N2, N3, and S2. The sleeve 63*b* can rotate by a driving source (not shown). The sleeve 63*b* rotates counterclockwise (in the direction of the arrow J1). The photoconductive drum 12*b* (see FIG. 2) rotates clockwise along the rotation direction J1 of the sleeve 63*b* (in the roller rotation direction J1).

The developer moves on the developing roller 63 with the rotation of the sleeve 63*b*. The developer is napped by the magnetic force when the developer passes on the magnetic pole portions N1, S1, N2, N3, and S2. By napping the developer, the toner is separated from the developer and a toner cloud is generated. The toner cloud is a cause of toner scattering.

The developer is adhered to the developing roller 63 by the magnetic force of the holding pole N3. The developer adhered to the developing roller 63 is conveyed to the developing pole N1 through the second conveying pole S2. The developing pole N1 forms a developing region. In the developing region, the toner contained in the developer moves from the developing roller 63 to the photoconductive drum 12*b* (see FIG. 2). With the toner, a developed image is formed on the surface of the photoconductive drum 12*b*. After the developed image is formed on the surface of the photoconductive drum 12*b*, the developer is conveyed to the separating pole N2 through the first conveying pole S1. By the magnetic repulsion between the separating pole N2 and the holding pole N3, the developer adhered to the developing roller 63 is separated.

A doctor blade 66 of the opening portion 60*h* in the housing 60 regulates the layer thickness of the developer held on the developing roller 63.

The shield portion 64 shields a flow of air from the developing device 12*a* to the photoconductive drum 12*b* (see FIG. 2). The shield portion 64 is provided between the doctor blade 66 and the photoconductive drum 12*b*. The shield portion 64 extends from the housing 60 so as to close the gap between the doctor blade 66 and the developing roller 63.

The gap forming member 71 forms a first gap G1 between the gap forming member 71 and the developing roller 63. The gap forming member 71 faces the developing roller 63 through the first gap G1. The gap forming member 71 is located on the opposite side to the second mixer 62 across the developing roller 63. The gap forming member 71 forms a second gap G2 between the gap forming member 71 and the housing 60. The gap forming member 71 faces the housing 60 through the second gap G2. Hereinafter, a portion 73 facing the gap forming member 71 through the second gap G2 of the housing 60 is also referred to as "case body 73". The gap forming member 71 extends in the roller axial direction Vg (see FIG. 6).

Figure 6:
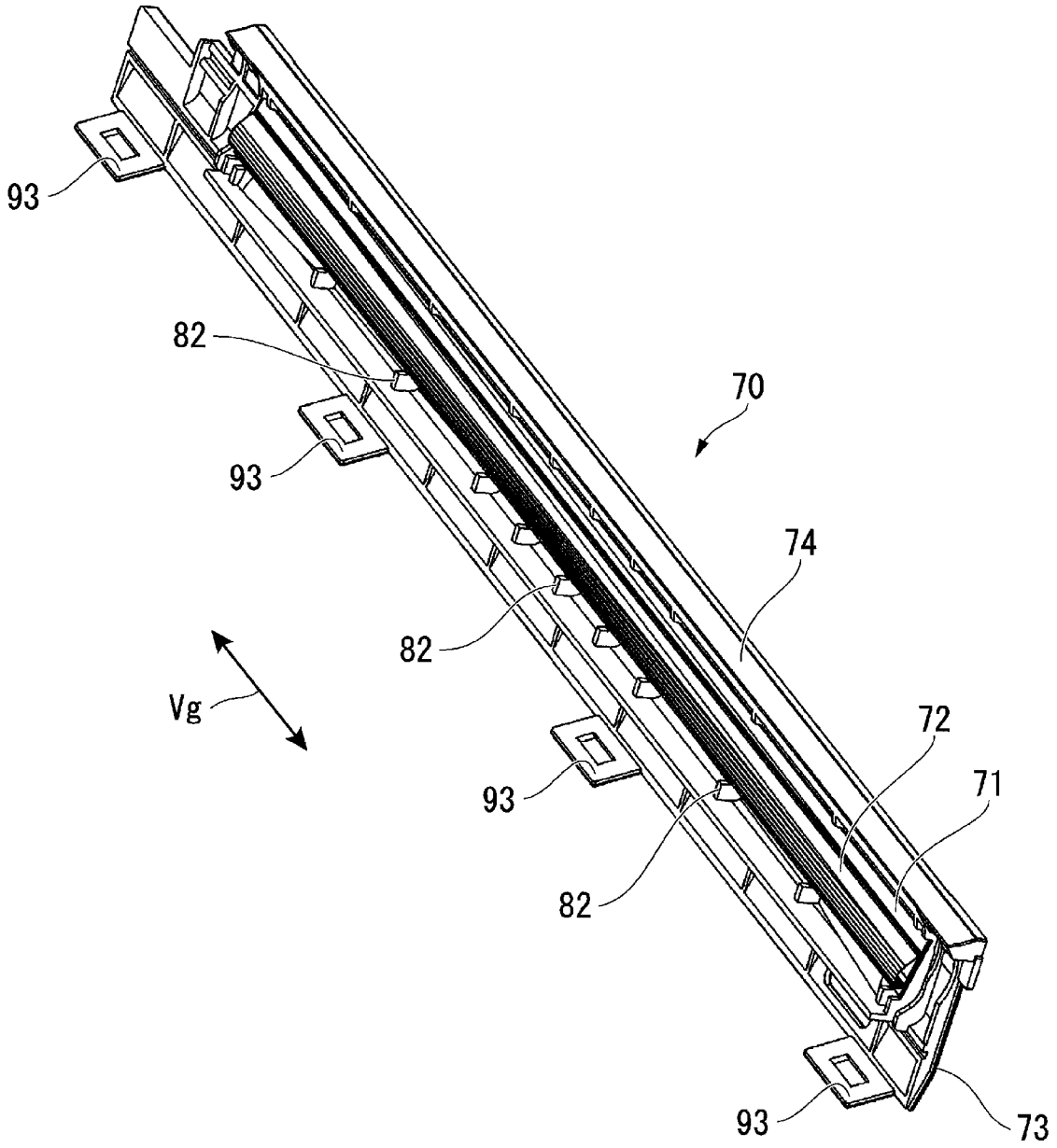
FIG. 6 illustrates a perspective view of a shield member and a case body according to an embodiment.
Figure 7:
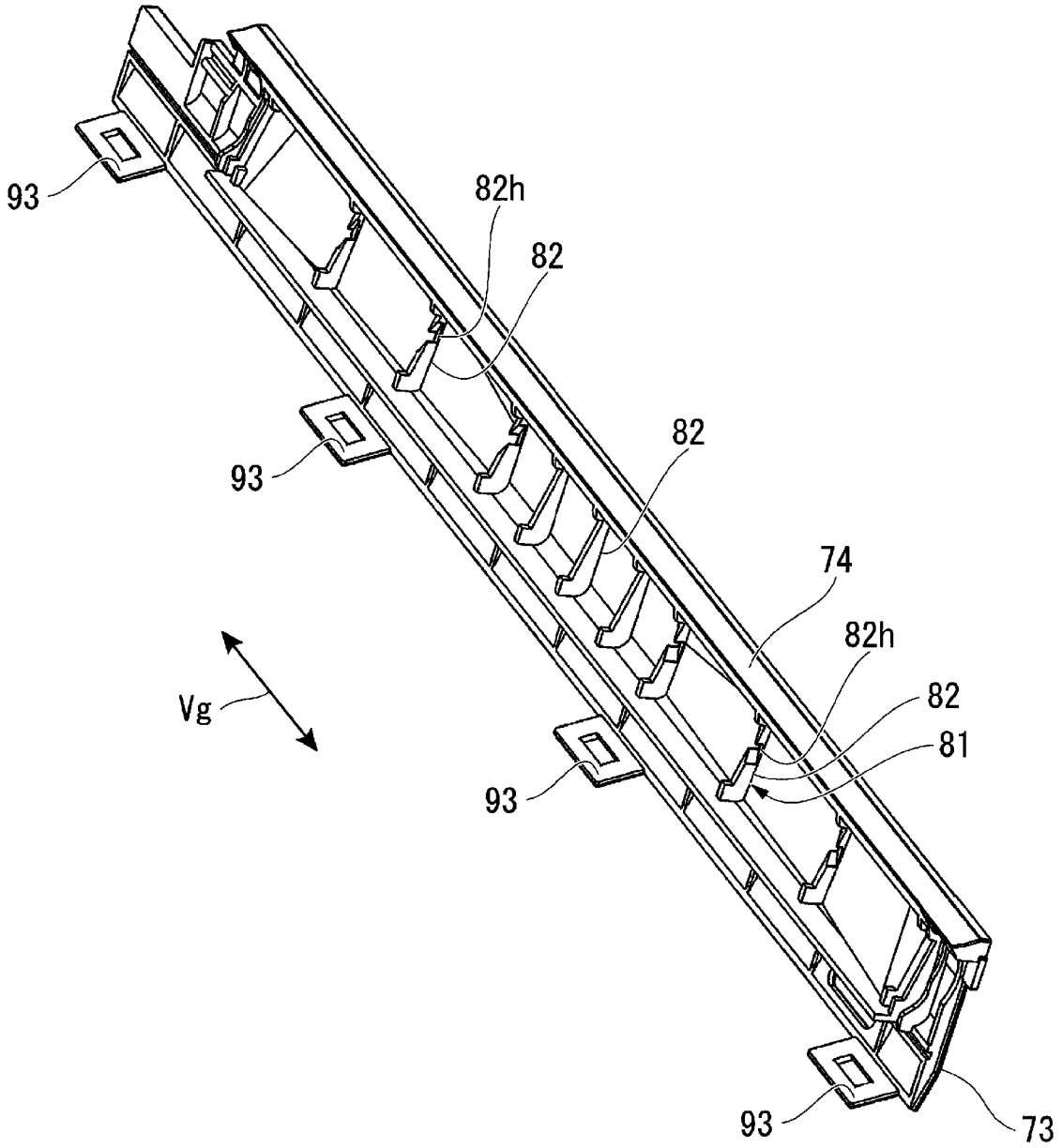
FIG. 7 illustrates a perspective view of the case body.

FIG. 6 illustrates a perspective view of the shield member 72 and the case body 73. FIG. 7 illustrates a perspective view of the case body 73.

As shown in FIG. 7, the case body 73 includes a holding portion 81 and an engaging portion 93. For example, the case body 73, the holding portion 81, and the engaging portion 93 are integrally formed of the same member.

The case body 73 has a plate shape extending in the roller axial direction Vg. The holding portion 81 extends from the case body 73 to the gap forming member 71 (see FIG. 4) and holds the gap forming member 71. The holding portion 81 includes a plurality of ribs 82 spaced apart from one another in the roller axial direction Vg. In the rib 82 on the outside in the roller axial direction Vg among the plurality of ribs 82, a notch 82*h* is formed.

As shown in FIG. 4, the shield member 72 is disposed in the first gap G1. The shield member 72 is provided between the gap forming member 71 and the developing roller 63. The shield member 72 is provided on the downstream side in the roller rotation direction J1 with respect to the developing pole N1. The shield member 72 has a loop shape. The shield member 72 is supported by the gap forming member 71. As shown in FIG. 6, the shield member 72 extends in the roller axial direction Vg. The shield member 72 is attached to the rib 82 through the gap forming member 71. For example, on the gap forming member 71, a double-sided tape (not shown) is provided. For example, the shield member 72 is attached to the rib 82 with the double-sided tape of the gap forming member 71.

As shown in FIG. 4, a portion of the shield member 72 is in contact with the developing roller 63, and therefore, with the rotation of the developing roller 63, the shield member 72 serves as a wall and shields an air current flowing into the developing device 12*a*. The first gap G1 is a gap between the developing roller 63 and the gap forming member 71. The shield member 72 has a function as a valve that shields the flow of air containing the toner flowing backward in the opposite direction to the roller rotation direction J1 so as to go outside the housing 60 from the inside of the housing 60 through the first gap G1. The shield member 72 is in contact with the developer layer (not shown) on the developing roller 63 at a low pressure to such an extent that the developer conveyance by the developing roller 63 is not impeded. The shield member 72 does not completely impede the flow of an air current, but regulates the flow of an air current. The shield member 72 contributes to generation of an air current circulation around the gap forming member 71 and flowing of mainly the generated air current in the developing device 12*a*. The shield member 72 is curved convexly toward the developing roller 63. The shield member 72 has flexibility. For example, the shield member 72 is an elastic body (porous elastic material) made of urethane or the like.

The shield member 72 is disposed at a facing position facing the first conveying pole S1 which is the intra-housing most upstream magnetic pole portion inside the housing 60. The shield member 72 is disposed at a position overlapped with the first conveying pole S1 in the normal direction of the developing roller 63. In other words, the shield member 72 is disposed on the first conveying pole S1 in the roller rotation direction J1.

In a portion facing the developing roller 63 on the upstream side in the roller rotation direction J1 of the shield member 72, an inclined surface 72*a* inclined toward a position at which the shield member 72 contacts the developer layer (not shown) is provided. For example, the inclined surface 72*a* forms an angle of 1° or more and 45° or less with respect to the tangent line of the developing roller 63.

Between the case body 73 and the gap forming member 71, a first opening E1 and a second opening E2 are provided.

The first opening E1 is formed on the downstream side in the roller rotation direction J1 with respect to the gap forming member 71. The first opening E1 is located on the downstream side in the roller rotation direction J1 in the second gap G2.

The second opening E2 communicates with the first opening E1 through the second gap G2. The second opening E2 is formed on the upstream side in the roller rotation direction J1 with respect to the gap forming member 71. The second opening E2 is located on the upstream side in the roller rotation direction J1 in the second gap G2.

On the downstream side in the roller rotation direction J1 with respect to the shield member 72, a third opening E3 is formed. The third opening E3 communicates with the downstream side in the roller rotation direction J1 in the first gap G1. The third opening E3 is located in the vicinity of the separating pole N2.

On the upstream side in the roller rotation direction J1 with respect to the shield member 72, a fourth opening E4 is formed. The fourth opening E4 communicates with the upstream side in the roller rotation direction J1 in the first gap G1.

Part of an air current passing through the shield member 72 flows from the third opening E3 to the first opening E1. The air current flowing to the first opening E1 flows to the second opening E2 and passes through the shield member 72 again with the rotation of the developing roller 63 through the fourth opening E4. That is, around the gap forming member 71, a circulating air current is formed. The gap forming member 71 has a function to adjust the air current direction determining the flow of the air current. Here, in the roller axial direction Vg, the width of the first opening E1 is represented by W1, the width of the second opening E2 is represented by W2, and the width of the third opening E3 is represented by W3. In order to allow the air current to circulate smoothly, the widths W1, W2, and W3 of the respective openings E1, E2, and E3 desirably have the following relationship: W3>W1>W2. In other words, the opening area of the flow path desirably decreases toward the second opening E2 from the third opening E3 through the first opening E1.

The case body 73 is provided on the opposite side to the developing roller 63 across the gap forming member 71. The second gap G2 is formed between the case body 73 and the gap forming member 71. The second gap G2 is provided along the roller rotation direction J1. The second gap G2 communicates with the first gap G1 through the first opening E1 and the third opening E3, and the second opening E2 and the fourth opening E4.

Figure 8:
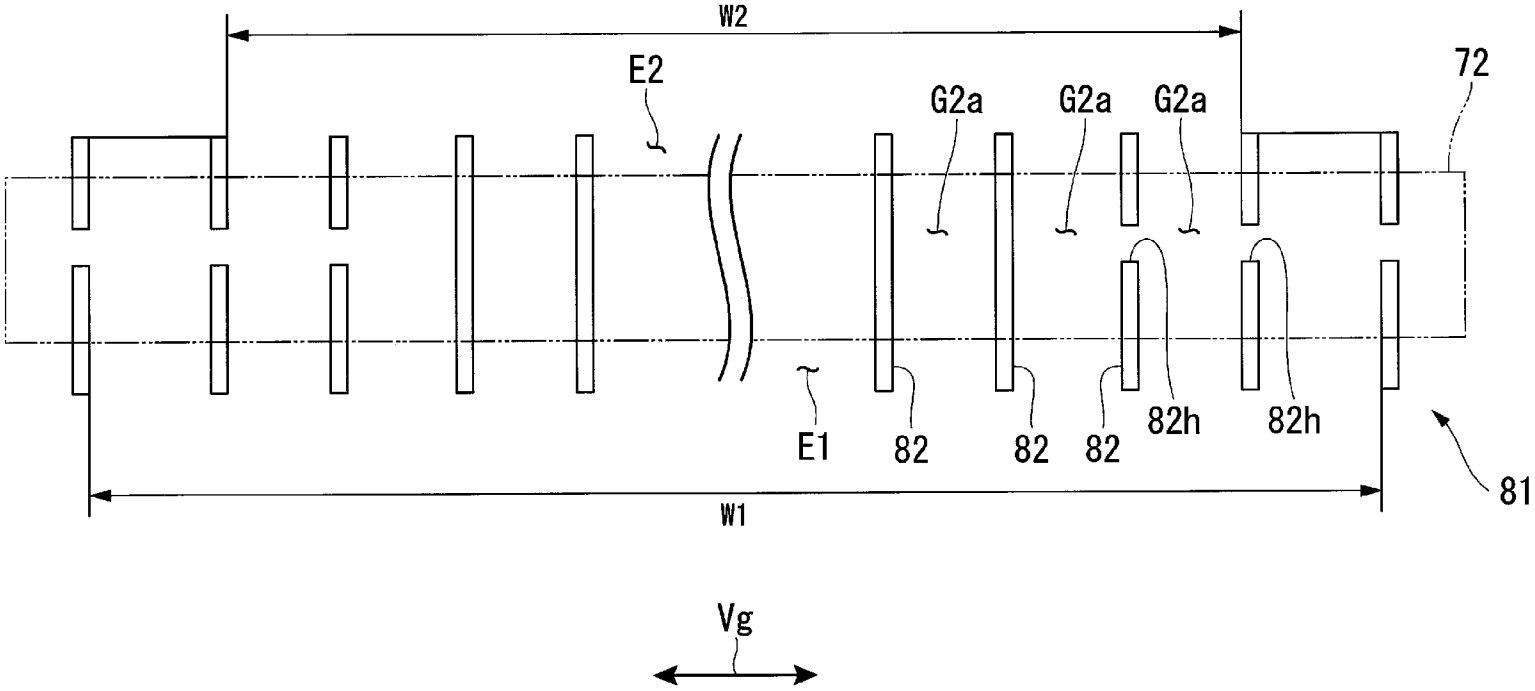
FIG. 8 illustrates a plan view of an example of a holding portion according to an embodiment.

FIG. 8 illustrates a plan view of an example of the holding portion 81. FIG. 8 illustrates the view of the holding portion 81 from the gap forming member 71 (see FIG. 7) side. In FIG. 8, the shield member 72 is indicated by a two-dot chain line.

As shown in FIG. 8, the holding portion 81 includes a plurality of ribs 82 spaced apart from one another in the roller axial direction Vg. The plurality of ribs 82 extend linearly in a direction orthogonal to the roller axial direction Vg when seen from the gap forming member 71 (see FIG. 7) side. By the plurality of ribs 82, a plurality of spaces G2*a* allowing the first opening E1 and the second opening E2 to communicate with each other are formed. The plurality of ribs 82 divide the second gap G2 (see FIG. 4) to form the plurality of spaces G2*a*. In the rib 82 on the outside in the roller axial direction Vg among the plurality of ribs 82, a notch 82*h* opening to a direction parallel to the roller axial direction Vg is formed. The notch 82*h* allows the plurality of spaces G2*a* adjacent to each other across the rib 82 to communicate with each other. In the example of FIG. 8, one notch 82*h* is formed in the rib 82.

The first opening E1 and the second opening E2 continue in the roller axial direction Vg. In the embodiment, the width W1 of the first opening E1 is the same as the width of the developing roller 63 (see FIG. 5). The width of the developing roller 63 (see FIG. 5) is the length of the developing roller 63 in the roller axial direction Vg. For example, the width W1 of the first opening E1 is about 310 mm.

In the roller axial direction Vg, the width W1 of the first opening E1 is larger than the width W2 of the second opening E2 (W1>W2). For example, the ratio W2/W1 of the width W2 of the second opening E2 to the width W1 of the first opening E1 is 0.5 or more and 0.8 or less.

Hereinafter, the length Z1 of the first opening E1 in the extending direction (height direction) of the holding portion 81 is also referred to as "the height Z1 of the first opening E1", and the length Z2 of the second opening E2 in the extending direction (height direction) of the holding portion 81 is also referred to as "the height Z2 of the second opening E2". In other words, the extending direction of the holding portion 81 is a direction orthogonal to the roller axial direction Vg, and is a facing direction of the gap forming member 71 and the case body 73. The height Z1 of the first opening E1 and the height Z2 of the second opening E2 are specified by the spacing between the case body 73 and the gap forming member 71 facing each other.

For example, the height Z1 of the first opening E1 and the height Z2 of the second opening E2 are preferably 0.5 mm or more and 5.0 mm or less. The height Z1 of the first opening E1 and the height Z2 of the second opening E2 are more preferably 1.0 mm or more.

As shown in FIG. 4, the engaging portion 93 extends from the case body 73 so as to enter a concave portion 60*i* of the housing 60. By the engaging portion 93, the case body 73 is detachably attached to the housing 60. In the housing 60, a wall portion 79 that forms the concave portion 60*i* is provided. The wall portion 79 forms a communication path that allows the first opening E1 and the third opening E3 to communicate with each other between the wall portion 79 and the gap forming member 71.

As shown in FIG. 6, the case body 73 configures a cover unit 70 together with the gap forming member 71 and the shield member 72. As shown in FIG. 4, the cover unit 70 covers the developing roller 63 from the side opposite to the second mixer 62. The cover unit 70 is detachably attached to the housing 60 with the engaging portion 93.

The guide portion 74 directs an air current discharged from the second gap G2 through the second opening E2 between the shield member 72 and the developing roller 63. The guide portion 74 guides air discharged from the second gap G2 through the second opening E2 to the first gap G1. The guide portion 74 has a guide surface 74*a* facing the gap forming member 71 through the fourth opening E4. The guide surface 74*a* is an inner surface of the guide portion 74 to contact an air current to be guided by the guide portion 74. The guide portion 74 extends to the developing roller 63 from an end portion in the vicinity of the second opening E2 in the housing 60. The guide portion 74 extends to the developing roller 63 from an end portion on the opening portion 60*h* side in the case body 73. For example, the guide portion 74 is integrally formed of the same member as the case body 73. The tip of the guide portion 74 is separated from the developing roller 63. Between the tip of the guide portion 74 and the developing roller 63, a gap 74*h* is formed.

Figure 9:
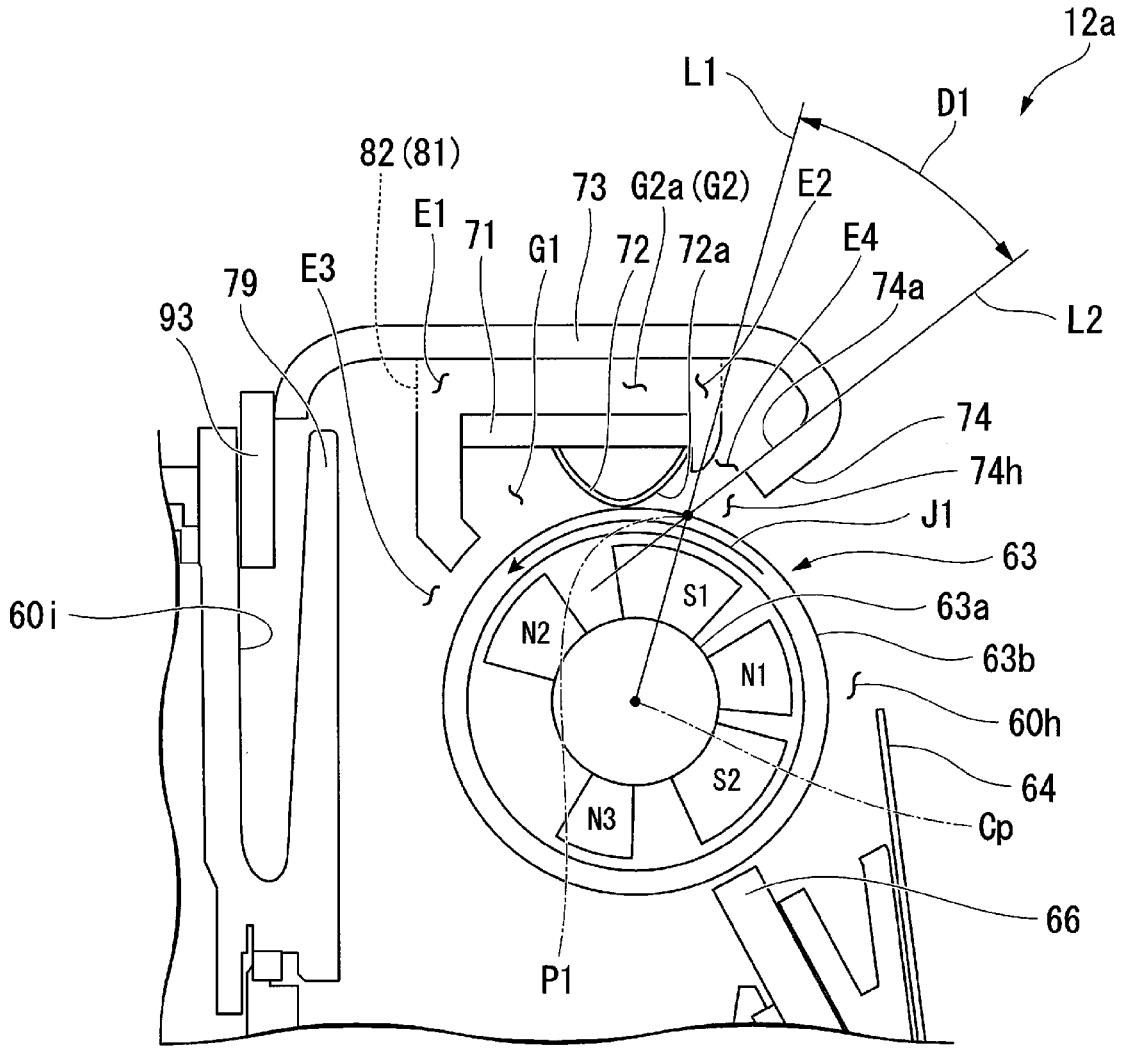
FIG. 9 illustrates a cross-sectional view of an example of a guide portion according to an embodiment.

FIG. 9 illustrates a cross-sectional view of an example of the guide portion 74. FIG. 9 is an enlarged view of a principal part of the guide portion 74 illustrated in FIG. 4.

As shown in FIG. 9, a first imaginary straight line L1 which is a reference line and a second imaginary straight line L2 which passes through the guide surface 74*a* are defined. The first imaginary straight line L1 is an imaginary straight line passing through an intersection P1 between the second imaginary straight line L2 and the developing roller 63 and the rotation center Cp of the developing roller 63. Hereinafter, an angle D1 formed by the first imaginary straight line L1 and the second imaginary straight line L2 seen from the roller axial direction Vg (see FIG. 5) is also referred to as "the angle D1 of the guide surface".

The direction in which the second imaginary straight line L2 leans toward the upstream side in the roller rotation direction J1 with respect to the first imaginary straight line L1 is assumed to be positive (plus). The angle D1 of the guide surface is an angle (positive angle) when the second imaginary straight line L2 is leaned clockwise with respect to the first imaginary straight line L1. The angle D1 of the guide surface is preferably plus 30° or more and 90° or less. The angle D1 of the guide surface is more preferably plus 45° or more.

Next, a flow of air around the developing device will be described.

Figure 10:
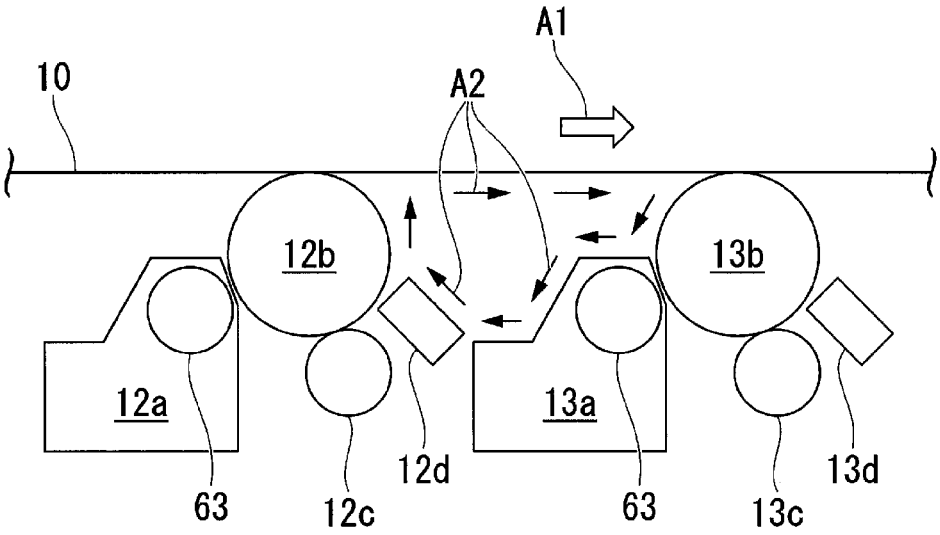
FIG. 10 illustrates a schematic side view of a developing device for illustrating a flow of air around the developing device according to an embodiment.
Figure 11:
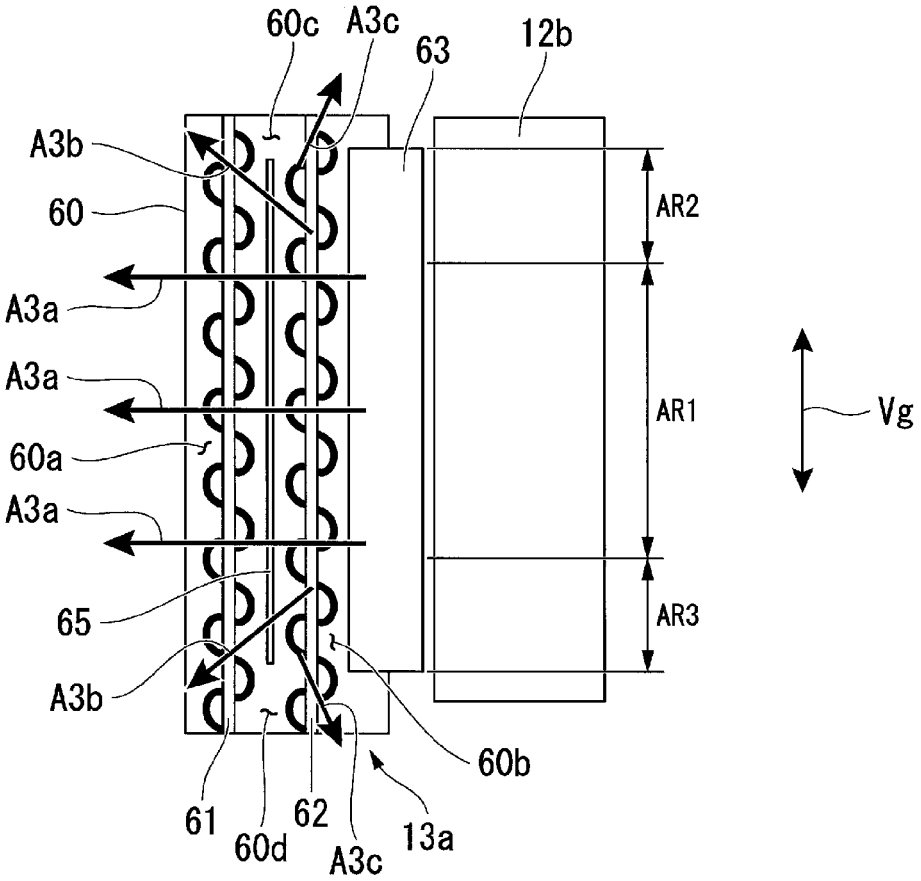
FIG. 11 illustrates a schematic plan view of a developing device for illustrating a flow of air around the developing device according to an embodiment.

FIG. 10 illustrates a schematic side view of a developing device to explain a flow of air around the developing device. FIG. 11 illustrates a plan view of the developing device to explain a flow of air around the developing device. In FIGS. 10 and 11, a flow of air around the developing device 13*a* located on the downstream side in the rotation direction of the intermediate transfer body 10 (in the direction of the arrow A1) of the developing device 12*a* is illustrated.

As shown in FIG. 10, air around the developing device 13*a* flows in the direction of the arrow A2 in a space between the developing device 13*a* and the intermediate transfer body 10.

As shown in FIG. 11, in the space between the developing device 13*a* and the intermediate transfer body 10 (see FIG. 10), a region AR1 in a central portion in the roller axial direction Vg and regions AR2 and AR3 in end portions in the roller axial direction Vg are defined. Hereinafter, the region AR1 in the central portion in the roller axial direction Vg is also referred to as "central portion region AR1", and the regions AR2 and AR3 in the end portions in the roller axial direction Vg are also referred to as "end portion regions AR2 and AR3".

For example, in the roller axial direction Vg, the width of each of the end portion regions AR2 and AR3 is 15% or more and 20% or less of the width of the intermediate transfer body 10. For example, in the roller axial direction Vg, when the width of the intermediate transfer body 10 is set to 330 mm and the width of the developing roller 63 is set to 310 mm, the width of each of the end portion regions AR2 and AR3 corresponds to 30 mm or more and 45 mm or less from the end portion of the developing roller 63.

In the space between the developing device 13*a* and the intermediate transfer body 10 (see FIG. 10), the flow of air in the central portion region AR1 is different from the flow of air in the end portion regions AR2 and AR3. In the central portion region AR1, air around the developing device 13*a* flows in the direction of the arrow A3*a* in the space between the developing device 13*a* and the intermediate transfer body 10. As shown in FIG. 10, in the central portion region AR1 (see FIG. 11), air around the developing device 13*a* flows in the same direction as the rotation direction of the intermediate transfer body 10 (the direction of the arrow A1) in the vicinity of the intermediate transfer body 10. On the other hand, in the central portion region AR1 (see FIG. 11), air around the developing device 13*a* flows in the opposite direction to the rotation direction of the intermediate transfer body 10 (the direction of the arrow A1) in the vicinity of the developing device 13*a*. That is, in the central portion region AR1 (see FIG. 11), air around the developing device 13*a* circulates in the direction of the arrow A2 in the space between the developing device 13*a* and the intermediate transfer body 10. Even if air containing the toner leaks out of the developing device 13*a* in the central portion region AR1 (see FIG. 11), the toner is more likely to be conveyed to the intermediate transfer body 10, and therefore, a functional component such as the charger 12*c* is less likely to be contaminated.

As shown in FIG. 11, in the end portion regions AR2 and AR3, there is a flow of air to which a component in a direction (direction parallel to the roller axial direction Vg) orthogonal to the rotation direction (the direction of the arrow A1) of the intermediate transfer body 10 is added. In the end portion regions AR2 and AR3, air around the developing device 13*a* flows in the direction of the arrow A3*b* or in the direction of the arrow A3*c* in the space between the developing device 13*a* and the intermediate transfer body 10 (see FIG. 10). If air containing the toner leaks out of the developing device 13*a* in the end portion regions AR2 and AR3, the toner is less likely to be conveyed to the intermediate transfer body 10, and therefore, a functional component such as the charger 12*c* is less likely to be contaminated.

Next, a flow of air in the developing device 12*a* will be described.

Figure 12:
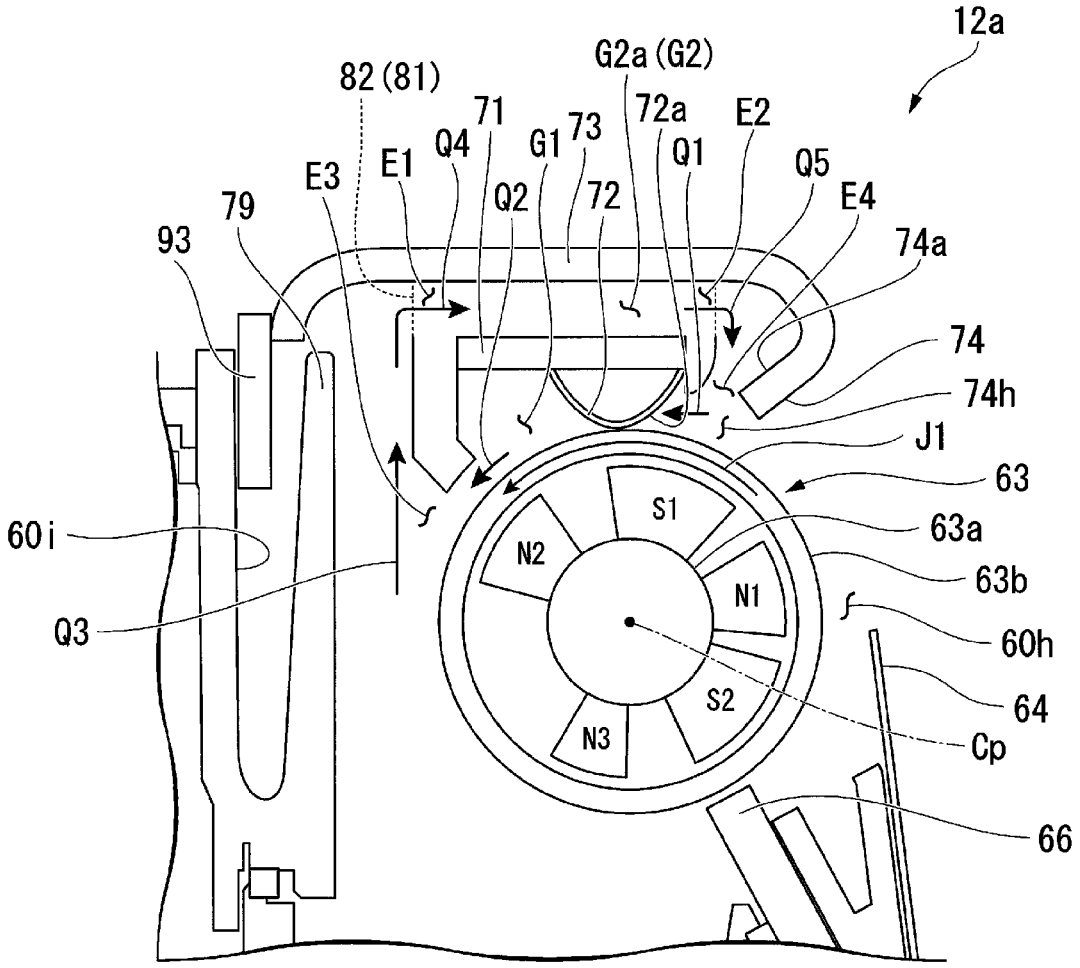
FIG. 12 is a cross-sectional view of a developing device for illustrating a flow of air in the developing device according to an embodiment.

FIG. 12 illustrates a cross-sectional view of the developing device 12*a* to explain a flow of air in the developing device 12*a*. FIG. 12 illustrates a view corresponding to FIG. 9.

As shown in FIG. 12, by the rotation of the developing roller 63 in the direction of the arrow J1, air flows in the housing 60 through the gap 74*h*. When air flows in the housing 60, a flow of air occurs in the directions of the arrows Q1 and Q2 in the first gap G1. When air enters the inside of the housing 60, the pressure in the housing 60 increases, and therefore, a flow of air occurs in the direction of the arrow Q3 from the inside to the outside of the housing 60 through the third opening E3.

The flow of air in the direction of the arrow Q3 goes to the gap 74*h* while taking in the toner separated from the developer in the housing 60, and therefore, a flow of air occurs in the directions of the arrows Q4 and Q5 toward the fourth opening E4 in the second gap G2. When air containing the toner flows in the direction of the arrow Q5, the air is guided to the first gap G1 by the guide surface 74*a*, and therefore, almost all the air containing the toner flows in the first gap G1.

The air containing the toner flowing in the first gap G1 flows sequentially in the directions of the arrows Q1, Q2, Q3, Q4, and Q5 in this order in the housing 60. That is, a circulation path of the flow of air containing the toner is formed in the housing 60 by the first gap G1, the second gap G2, the first opening E1, the second opening E2, the third opening E3, and the fourth opening E4.

Next, an example of toner scattering in the developing device will be described.

Figure 13:
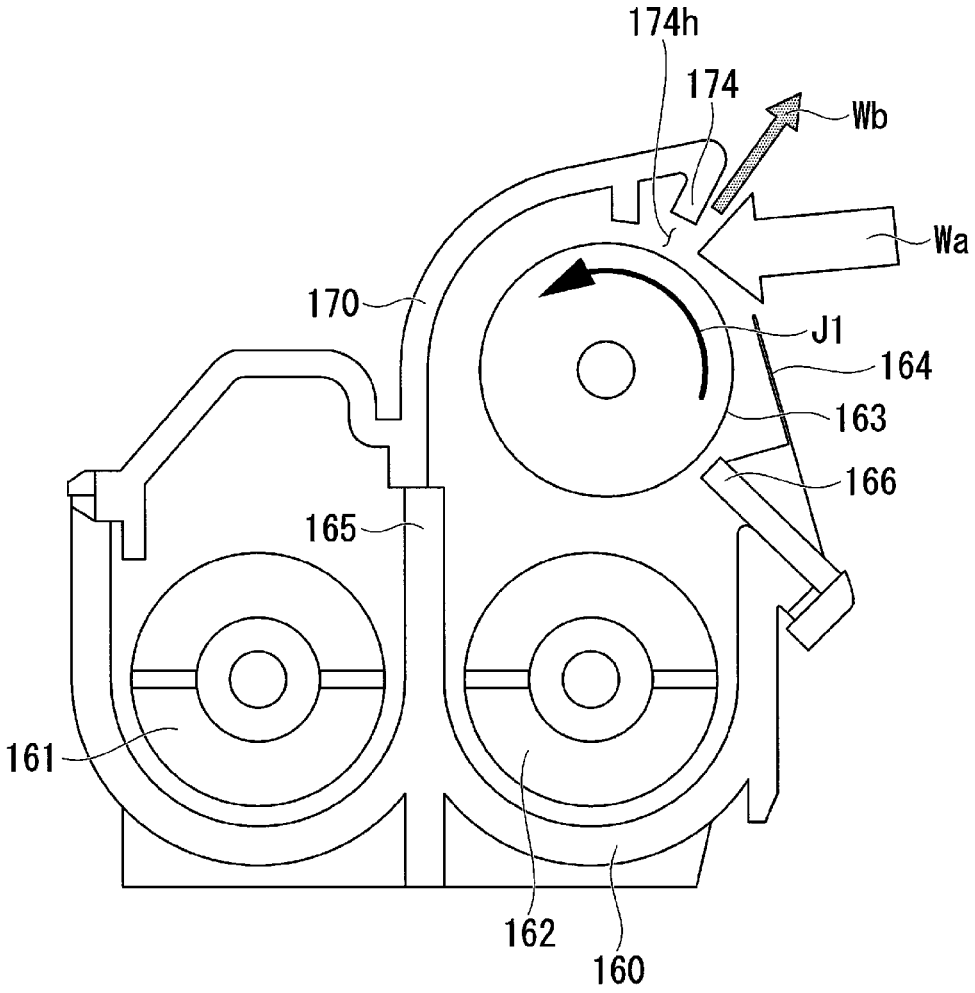
FIG. 13 is a cross-sectional view of a developing device for illustrating an example of tonner scattering in the developing device.

FIG. 13 illustrates a cross-sectional view of a developing device to explain an example of tonner scattering in the developing device. In FIG. 13, cross-hatching is omitted. The developing device of FIG. 13 does not include the gap forming member. In FIG. 13, the developing device includes a housing 160, a first mixer 161, a second mixer 162, a developing roller 163, a shield portion 164, a partition 165, a doctor blade 166, a cover member 170, a guide portion 174, and a gap 174*h*.

On the developing roller 163, a developer (not shown) is carried. As shown in FIG. 13, in accordance with the rotation of the developing roller 163, a flow that the developer is drawn into the developing device occurs, and air enters the inside of the developing device from the gap 174*h* (the arrow Wa in FIG. 13). When air enters the inside of the developing device, the pressure in the developing device increases. When the pressure in the developing device increases, air containing the toner in the developing device leaks out of the developing device and causes toner scattering (the arrow Wb in FIG. 13).

As a result of intensive studies, the inventors of the present application found out the following configurations for preventing toner scattering.

First, a flow of air in a circulation-type developing device will be described.

Figure 14:
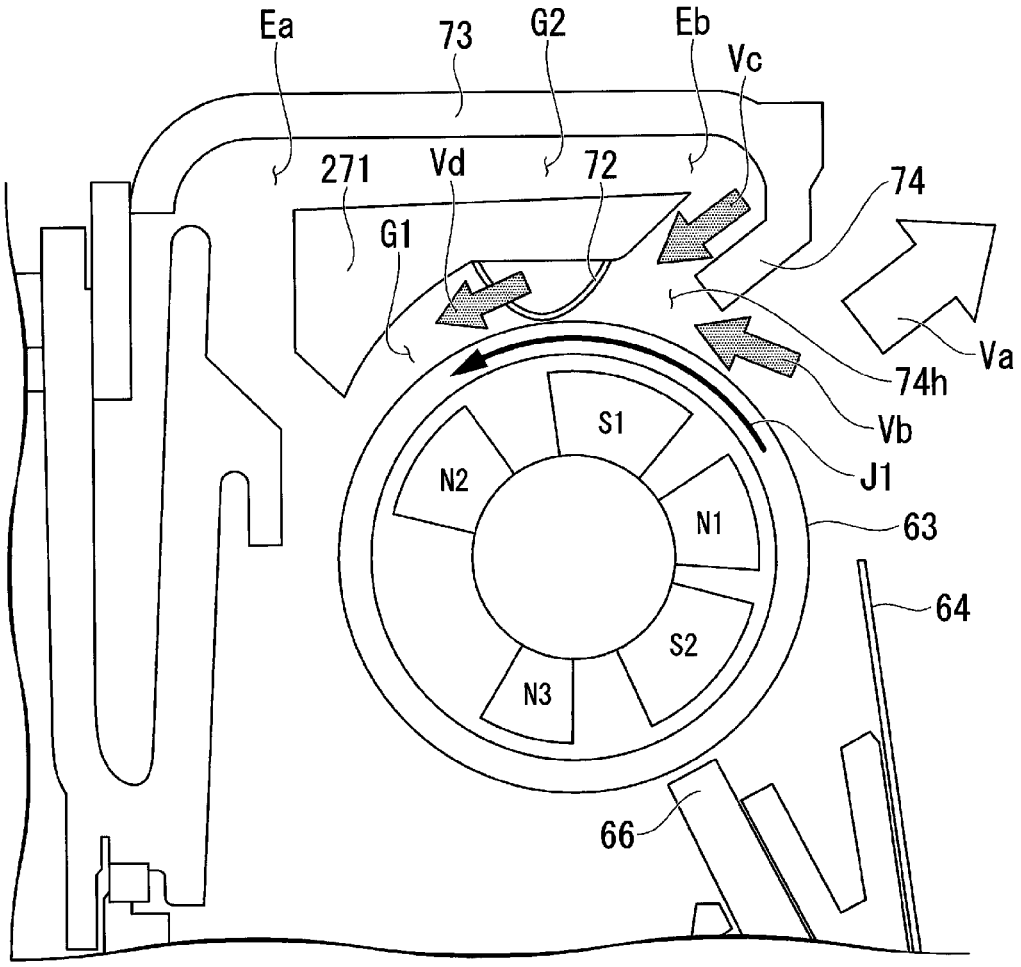
FIG. 14 is a cross-sectional view of a circulation-type developing device for illustrating a flow of air in the circulation-type developing device.

FIG. 14 illustrates a cross-sectional view of a circulation-type developing device to explain a flow of air in the circulation-type developing device. In FIG. 14, cross-hatching is omitted. In FIG. 14, the circulation-type developing device includes a gap forming member 271. For example, the gap forming member 271 is supported by a rib (not shown) provided in the case body 73. The shield member 72 is attached to the gap forming member 271.

Between the gap forming member 721 and the developing roller 63, the first gap G1 is provided. The gap forming member 271 forms the second gap G2 between the gap forming member 271 and the case body 73 (housing). At a position on the downstream side in the roller rotation direction J1 with respect to the gap forming member 271, an inlet opening Ea is provided. At a position on the upstream side in the roller rotation direction J1 with respect to the gap forming member 271, an outlet opening Eb is provided. The first gap G1 and the second gap G2 communicate with each other through the inlet opening Ea and the outlet opening Eb. For example, the first gap G1 and the second gap G2 may be formed in parallel to each other by superimposing the gap forming member 271 on the case body 73 in a portion in proximity to the developing roller 63.

As shown in FIG. 14, when air enters the inside of the developing device from the gap 74*h* in accordance with the rotation of the developing roller 63, the pressure in the developing device increases. When the pressure in the developing device increases, air in the developing device passes through the second gap G2 from the inlet opening Ea and is discharged from the outlet opening Eb (the arrow Va in FIG. 14). Air discharged from the outlet opening Eb is drawn into the developing device by the action of the first conveying pole S1 (the arrows Vb, Vc, and Vd in FIG. 14). The first conveying pole S1 is an intra-housing most upstream magnetic pole portion located on the most upstream side in the roller rotation direction J1 in the housing. The first conveying pole S1 plays a role in drawing air discharged to the outside from the inside of the developing device into the developing device. The layer of the developer napped by the magnetic force of the first conveying pole S1 takes in air and draws the air into the developing device.

The doctor blade 66 regulates the layer thickness of the developer carried on the developing roller 63. The layer thickness of the developer refers to the height of the developer nap. The doctor blade 66 is disposed in a portion of the housing located on the upstream side in the roller rotation direction J1 of a portion in proximity to the developing roller 63 and the photoconductive drum (not shown) so as to form the developer layer having an appropriate layer thickness. When the layer thickness of the developer is too small, image density may be insufficient. When the layer thickness of the developer is too large, image density may be excessive or an image with a void is generated. When the layer thickness of the developer is too small or too large in this manner, an image defect occurs. Therefore, the layer thickness of the developer needs to be set within an appropriate range.

Next, a void will be described.

In an image, a portion in which an image density is higher than the average is referred to as "high-density portion", and a portion in which an image density is lower than the average is referred to as "low-density portion". The "void" refers to a phenomenon that an image having a high-density portion and a low-density portion are arranged in parallel and the image density of the low-density portion is lower than a given density in a boundary portion between the high-density portion and the low-density portion.

The peripheral speed of the developing roller is larger than that of the photoconductive drum. For example, when the peripheral speed of the photoconductive drum is assumed to be 1, the peripheral speed of the developing roller is 1.85. A void is generated by scraping off the toner from the photoconductive body when the developer in which the content of the toner is reduced by printing a high-density portion passes the surface of the photoconductive body after printing a low-density portion. That is, a void is generated by drawing the toner on the photoconductive body by the developer having a low toner content on the developing roller. A void is generated by a combination of an electrical factor with a physical factor.

As the pressure of the developer nap against the photoconductive drum is higher, a void becomes more evident. That is, as the layer thickness of the developer is larger, a void becomes more evident. When the spacing between the photoconductive drum and the developing roller is enlarged, the pressure of the developer nap against the photoconductive drum can be decreased. However, when the spacing between the photoconductive drum and the developing roller is enlarged, an edge effect is increased, and therefore, the improvement of the void is small.

Next, the edge effect will be described.

Figure 15:
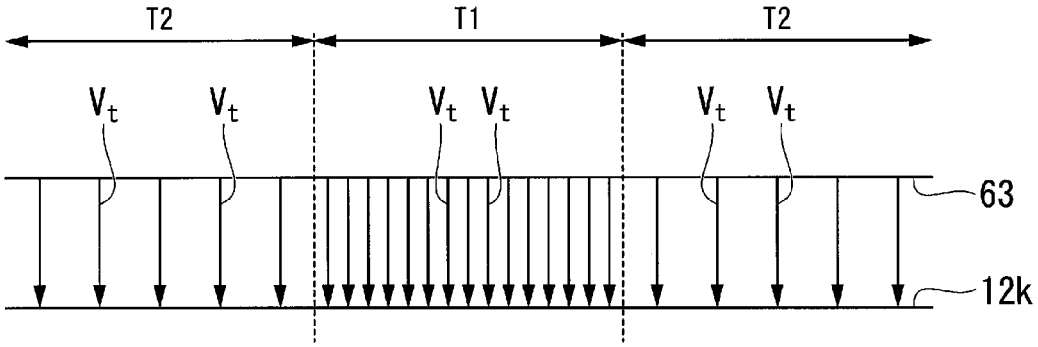
FIG. 15 is an explanatory diagram to explain a situation when a spacing between a photoconductive body and a developing roller is smaller than a threshold value.
Figure 16:
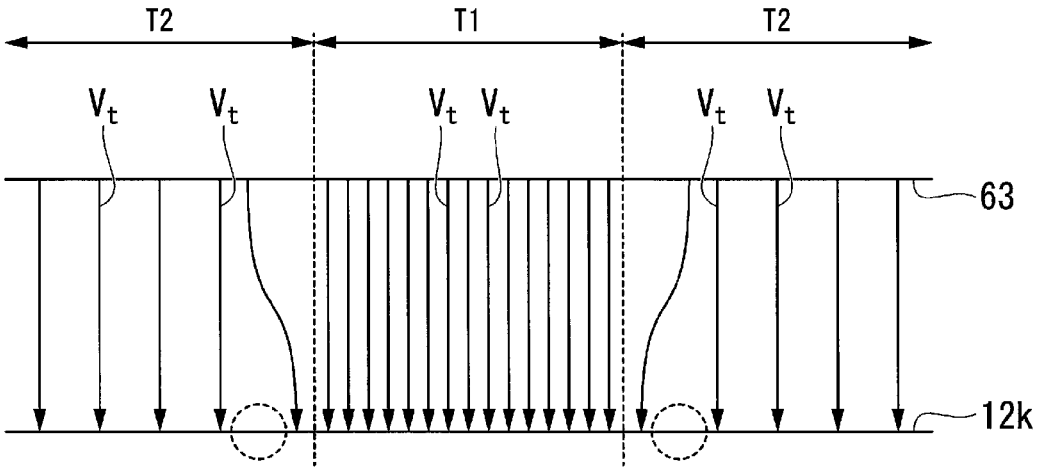
FIG. 16 is an explanatory diagram to explain a situation when a spacing between a photoconductive body and a developing roller is larger than a threshold value.

FIG. 15 is an explanatory diagram to explain a situation when a spacing between a photoconductive body and a developing roller is smaller than a threshold value. FIG. 16 is an explanatory diagram to explain a situation when a spacing between a photoconductive body and a developing roller is larger than a threshold value. In FIGS. 15 and 16, a reference numeral 12*k* denotes a photoconductive body (a photoconductive region on the outer peripheral surface of a photoconductive drum), a reference numeral 63 denotes a developing roller, a reference numeral T1 denotes a high-density portion, a reference numeral T2 denotes a low-density portion, and an arrow Vt denotes a toner moving on the photoconductive body 12*k*.

As shown in FIG. 15, when the spacing between the photoconductive body 12*k* and the developing roller 63 is smaller than a threshold value, the flow of the toner moving on the photoconductive body 12*k* becomes a uniform flow in the respective density portions T1 and T2. When the spacing between the photoconductive body 12*k* and the developing roller 63 is smaller than a threshold value, the image density in the low-density portion is maintained in a boundary portion between the high-density portion and the low-density portion.

As shown in FIG. 16, when the spacing between the photoconductive body 12*k* and the developing roller 63 is larger than a threshold value, the flow of the toner moving on the photoconductive body 12*k* becomes a non-uniform flow in the low-density portion T2. A bias occurs in the flow of the toner in the vicinity of the high-density portion in the low-density portion. When the spacing between the photoconductive body 12*k* and the developing roller 63 is larger than a threshold value, the image density in the low-density portion is lower than a given density in a boundary portion (a portion surrounded by a dotted line circle) between the high-density portion and the low-density portion (an edge effect is increased).

Next, a relationship between the layer thickness of the developer and toner scattering will be described.

As a result of intensive studies, the inventors of the present application found out that as the layer thickness of the developer on the first conveying pole S1 becomes smaller, toner scattering becomes more likely to occur remarkably. As described above, the first conveying pole S1 plays a role in taking air outside the developing device in the developing device through the first gap G1 and increasing the pressure in the developing device. Further, the first conveying pole S1 plays a role in taking in air inside the developing device discharged from the outlet opening Eb through the second gap G2 and drawing the air into the developing device through the first gap G1. As the layer thickness of the developer on the first conveying pole S1 is smaller, a force to take in air is decreased. In the circulation-type developing device, the effect of the decrease in the latter force, that is, the force to take in air inside the developing device discharged from the outlet opening Eb through the second gap G2 and draw the air into the developing device through the first gap G1 is large. Therefore, as the layer thickness of the developer on the first conveying pole S1 becomes smaller, air discharged outside the developing device is considered to increase.

For example, the layer thickness of the developer on the first conveying pole S1 is 0.6 mm or more and 1.4 mm or less. The layer thickness of the developer on the first conveying pole S1 is preferably 0.85 mm or more and 1.4 mm or less. The layer thickness of the developer on the first conveying pole S1 is more preferably 0.85 mm or more and 1.1 mm or less.

According to the present embodiment, the image forming apparatus 1 (developing device 12*a*) includes the housing 60 and the developing roller 63. The developing roller 63 is provided rotatably inside the housing 60. The developing roller 63 includes the developing pole N1. The developing roller 63 performs development with the developer carried by the magnetic force of the developing pole N1. The developing roller 63 includes the first conveying pole S1. The first conveying pole S1 is located on the most upstream side in the roller rotation direction J1 inside the housing 60. The layer thickness of the developer on the first conveying pole S1 is 0.6 mm or more and 1.4 mm or less. According to the above-mentioned configuration, the following effect is achieved.

The first conveying pole S1 plays a role in drawing air discharged to the outside from the inside of the developing device into the developing device. The layer of the developer napped by the magnetic force of the first conveying pole S1 takes in air and draws the air into the developing device. When the layer thickness of the developer on the first conveying pole S1 is less than 0.6 mm, a force to draw air discharged outside the developing device into the developing device is excessively decreased, and therefore, toner scattering may occur. Further, when the layer thickness of the developer on the first conveying pole S1 is less than 0.6 mm, the absolute amount of the developer is excessively decreased, and therefore, an insufficient image density may be resulted. On the other hand, when the layer thickness of the developer on the first conveying pole S1 exceeds 1.4 mm, the pressure of the developer nap against the photoconductive drum is too high, and therefore, a void may be generated. According to the present embodiment, the layer thickness of the developer on the first conveying pole S1 is 0.6 mm or more, and therefore, a force to draw air discharged outside the developing device into the developing device can be kept moderate. As a result, toner scattering outside the developing device can be suppressed. In addition, when the layer thickness of the developer on the first conveying pole S1 is 0.6 mm or more, the absolute amount of the developer can be kept moderate. Therefore, the occurrence of an insufficient image density can be suppressed. Moreover, when the layer thickness of the developer on the first conveying pole S1 is 1.4 mm or less, the pressure of the developer nap against the photoconductive drum can be kept moderate. Therefore, the generation of an image with a void can be suppressed.

The developing device 12*a* further includes the gap forming member 71. The gap forming member 71 forms the first gap G1 between the gap forming member 71 and the developing roller 63. The gap forming member 71 forms the second gap G2 between the gap forming member 71 and the housing 60. The gap forming member 71 is provided in the housing 60. The gap forming member 71 is provided on the downstream side in the roller rotation direction J1 with respect to the developing pole N1. Between the housing 60 and the gap forming member 71, the first opening E1 and the second opening E2 are provided. The first opening E1 is formed on the downstream side in the roller rotation direction J1 with respect to the gap forming member 71. The second opening E2 communicates with the first opening E1 through the second gap G2. The second opening E2 is formed on the upstream side in the roller rotation direction J1 with respect to the gap forming member 71. According to the above-mentioned configuration, the following effect is achieved. Since a circulation path of the flow of air containing the toner is formed in the housing 60 by the first gap G1, the second gap G2, the first opening E1, and the second opening E2, the air containing the toner can be prevented from spouting out from the developing device. Accordingly, toner scattering outside the developing device can be suppressed.

The layer thickness of the developer on the first conveying pole S1 is more preferably 0.85 mm or more and 1.4 mm or less. When the layer thickness of the developer on the first conveying pole S1 is 0.85 mm or more, a force to draw air discharged outside the developing device into the developing device can be kept more moderate. Therefore, this configuration is more favorable from the viewpoint of effectively suppressing toner scattering outside the developing device.

The layer thickness of the developer on the first conveying pole S1 is more preferably 0.85 mm or more and 1.1 mm or less. When the layer thickness of the developer on the first conveying pole S1 is 1.1 mm or less, the pressure of the developer nap against the photoconductive drum can be kept more moderate. Therefore, this configuration is more favorable from the viewpoint of effectively suppressing the generation of an image with a void.

The image forming apparatus 1 further includes the intermediate transfer body 10 and the plurality of photoconductive drums 12*b* to 16*b*. The intermediate transfer body 10 is endless. The intermediate transfer body 10 is provided rotatably. The plurality of photoconductive drums 12*b* to 16*b* are provided along the rotation direction of the intermediate transfer body 10. The developing roller 63 is provided at a position facing each of the plurality of photoconductive drums 12*b* to 16*b*. According to the above-mentioned configuration, the following effect is achieved. According to the configuration in which the layer thickness of the developer on the first conveying pole S1 of each developing roller 63 is 0.6 mm or more and 1.4 mm or less, the generation of an image with a void can be suppressed while suppressing toner scattering outside the developing device in each developing device. Therefore, in a tandem-type image forming apparatus, each of toner scattering outside the developing device and the generation of an image with a void can be effectively suppressed.

The developing device 12*a* further includes the shield member 72. The shield member 72 is disposed in the first gap G1. The shield member 72 is provided on the downstream side in the roller rotation direction J1 with respect to the developing pole N1. The shield member 72 is disposed at a facing position facing the first conveying pole S1 which is the intra-housing most upstream magnetic pole portion inside the housing 60. According to the above-mentioned configuration, the following effect is achieved. Since a toner cloud generated on the first conveying pole S1 can be kept inside the developing device 12*a*, tonner scattering outside the developing device 12*a* can be suppressed.

In the meantime, in order to reduce tonner scattering outside the developing device, a filter, a fan, and the like for recovering the scattered tonner might be taken in to consideration. However, the frequency of clogging of the filter that captures the tonner may be increased before the service life is reached. Further, when a filter is provided, a fan and a duct also need to be provided, and therefore, the size of the device may be increased. According to the embodiment, a filter does not need to be provided, and therefore, the configuration of the embodiment is favorable from the viewpoint of improving the maintainability and also avoiding an increase in the size of the device.

According to the configuration in which in the roller axial direction Vg, the width W1 of the first opening E1 is larger than the width W2 of the second opening E2 (W1>W2), the following effect is achieved. The flow of air containing the toner is likely to concentrate on the central portion region AR1 as compared with the case where the width W1 of the first opening E1 is equal to or smaller than the width W2 of the second opening E2 (W1≤W2). That is, the flow of air containing the toner is prevented from going to the end portion regions AR2 and AR3. Even if air containing the toner leaks out of the developing device 13*a* in the central portion region AR1, the toner is more likely to be conveyed to the intermediate transfer body 10, and therefore, a functional component such as the charger 12*c* is less likely to be contaminated. Accordingly, a functional component such as the charger 12*c* can be prevented from being contaminated.

According to the configuration in which the ratio W2/W1 of the width W2 of the second opening E2 to the width W1 of the first opening E1 is 0.5 or more and 0.8 or less, the following effect is achieved. When W2/W1 is less than 0.5, the flow of air containing the toner is more likely go to the end portion regions AR2 and AR3. This can be because when W2/W1 is less than 0.5, the width W2 of the second opening E2 is too narrow and the discharge of air in the developing device 12*a* becomes insufficient, and the pressure in the developing device 12*a* is excessively increased. On the other hand, when W2/W1 exceeds 0.8, the width W2 of the second opening E2 is too wide, and the flow of air containing the toner hardly may concentrate on the central portion region AR1. According to the embodiment, W2/W1 is 0.5 or more and 0.8 or less, and therefore, the flow of air containing the toner concentrates on the central portion region AR1, and thus, this configuration is favorable from the viewpoint of preventing a functional component such as the charger 12*c* from being contaminated.

According to the configuration in which the guide portion 74 which directs an air current discharged from the second gap G2 through the second opening E2 between the shield member 72 and the developing roller 63 is included, the following effect is achieved. By the guide portion 74, air containing the toner is guided to the first gap G1, and therefore, the air containing the toner can be prevented from spouting out from the developing device 12*a*. Accordingly, toner scattering outside the developing device 12*a* can be suppressed.

According to the configuration in which the case body 73 includes the holding portion 81 which extends to the gap forming member 71 and holds the gap forming member 71, the following effect is achieved. As compared with the case where a holding member for holding the gap forming member 71 is provided separately, the number of components is reduced, and the configuration of the device can be simplified.

According to the configuration in which the holding portion 81 includes the plurality of ribs 82 which are spaced apart from one another in the roller axial direction Vg and extend linearly in a direction orthogonal to the roller axial direction Vg when seen from the gap forming member 71 side, the following effect is achieved. By the plurality of ribs 82, a plurality of spaces G2*a* allowing the first opening E1 and the second opening E2 to communicate with each other are formed, and therefore, air containing the toner can be made to flow smoothly through the plurality of spaces G2*a*. When the air containing the toner flows smoothly through the plurality of spaces G2*a*, the air containing the toner can be made to flow smoothly through the circulation path including the plurality of spaces G2*a*. Therefore, the air containing the toner can be effectively prevented from spouting out from the developing device 12*a*.

According to the configuration in which the notch 82*h* opening to a direction parallel to the roller axial direction Vg is formed in the rib 82, the following effect is achieved. By the notch 82*h*, the plurality of spaces G2*a* adjacent to each other across the rib 82 communicate with each other, and therefore, this configuration is favorable from the viewpoint that the air containing the toner can be made to flow more smoothly through the circulation path including the plurality of spaces G2*a*.

According to the configuration in which the inclined surface 72*a* forms an angle of 45° or less with respect to the tangent line of the developing roller 63, the following effect is achieved. When the inclined surface 72*a* forms an angle exceeding 45° with respect to the tangent line of the developing roller 63, the developer on the developing roller 63 collides with the shield member 72, and a toner cloud may be generated. According to the configuration in which the inclined surface 72*a* forms an angle of 45° or less with respect to the tangent line of the developing roller 63, a toner cloud is less likely to be generated.

According to the configuration in which the side openings 60*c* and 60*d* for allowing the developer to circulate between the first chamber 60*a* and the second chamber 60*b* are formed on both sides in the roller axial direction Vg of the housing 60, the following effect is achieved. Through the side openings 60*c* and 60*d*, air on the second chamber 60*b* side easily enters the first chamber 60*a*. On the other hand, when the pressure in the developing device 12*a* increases, air containing the toner easily leaks out from both end portions in the roller axial direction Vg of the developing device 12*a*. According to the embodiment, the flow of air containing the toner is likely to concentrate on the central portion region AR1 as compared with the case where the width W1 of the first opening E1 is equal to or smaller than the width W2 of the second opening E2 (W1≤W2). Therefore, even if the side openings 60*c* and 60*d* are formed on both sides in the roller axial direction Vg of the housing 60, a functional component such as the charger 12*c* can be prevented from being contaminated.

According to the configuration in which the shield member 72 is disposed at a facing position facing the first conveying pole S1 which is the intra-housing most upstream magnetic pole portion inside the housing 60, the following effect is achieved. Since a toner cloud generated on the first conveying pole S1 can be kept inside the developing device 12*a*, this configuration is favorable from the viewpoint of suppressing tonner scattering outside the developing device 12*a*.

According to the configuration in which the angle D1 of the guide surface is plus 30° or more, the following effect is achieved. When the angle D1 of the guide surface is less than plus 30°, an effect of bending air discharged from the second gap G2 toward the first gap G1 is small. According to the present embodiment, the angle D1 of the guide surface is plus 30° or more, and therefore, air discharged from the second gap G2 can be sufficiently bent toward the first gap G1, and thus, this configuration is favorable from the viewpoint of suppressing tonner scattering outside the developing device 12*a*. Further, when the angle D1 of the guide surface is plus 45° or more, air discharged from the second gap G2 can be more effectively bent toward the first gap G1, and therefore, this configuration is more favorable from the viewpoint of suppressing tonner scattering outside the developing device 12*a*.

According to the configuration in which the guide surface 74*a* is an inner surface of the guide portion 74 contacting an air current to be guided by the guide portion 74, the following effect is achieved. By the guide surface 74*a*, air discharged from the second gap G2 can be more effectively bent toward the first gap G1, and therefore, this configuration is more favorable from the viewpoint of suppressing tonner scattering outside the developing device 12*a*.

According to the configuration in which the guide portion 74 extends to the developing roller 63 from an end portion in the vicinity of the second opening E2 in the housing 60, the following effect is achieved. When the guide portion 74 is integrally formed of the same member as the case body 73, a guide member does not need to be provided separately, and therefore, the number of components is reduced, and the configuration of the device can be simplified.

According to the configuration in which the height Z1 of the first opening E1 and the height Z2 of the second opening E2 are specified by the spacing between the case body 73 and the gap forming member 71 facing each other and are 0.5 mm or more, the following effect is achieved. When the height Z1 of the first opening E1 and the height Z2 of the second opening E2 are less than 0.5 mm, the flow of air through the second gap G2 becomes poor, and the efficiency of discharging air in the developing device 12*a* is more likely to go down. According to the present embodiment, the height Z1 of the first opening E1 and the height Z2 of the second opening E2 are 0.5 mm or more, and therefore, the flow of air through the second gap G2 can be made smooth. When air containing the toner flows smoothly through the second gap G2, the air containing the toner can be made to flow smoothly through the circulation path including the second gap G2. Therefore, the air containing the toner can be effectively prevented from spouting out from the developing device 12*a*. Further, when the height Z1 of the first opening E1 and the height Z2 of the second opening E2 are 1.0 mm or more, the flow of air through the second gap G2 can be made smoother, and therefore, this configuration is more favorable from the viewpoint of effectively preventing air containing the toner from spouting out from the developing device 12*a*.

Hereinafter, modification examples will be described.

The developing device 12*a* is not limited to a developing device including the gap forming member 71. For example, the developing device 12*a* may not include the gap forming member 71.

The developing device 12*a* is not limited to a developing device including the shield member 72. For example, the developing device 12*a* may not include the shield member 72.

The holding portion 81 is not limited to a holding portion including the plurality of ribs 82 which are spaced apart from one another in the roller axial direction Vg and extend linearly in a direction orthogonal to the roller axial direction Vg when seen from the gap forming member 71 side. For example, the holding portion 81 may include the plurality of ribs 82 which extend linearly in a direction crossing the roller axial direction Vg when seen from the gap forming member 71 side.

The guide portion 74 is not limited to a guide portion integrally formed of the same member as the case body 73. For example, the guide portion 74 may be formed separately from the case body 73.

The first opening E1 and the second opening E2 are not limited to a first opening and a second opening which continue in the roller axial direction Vg. For example, at least one of the first opening E1 and the second opening E2 may be divided in the roller axial direction Vg. Even if at least one of the first opening E1 and the second opening E2 is divided in the roller axial direction Vg, the height Z1 of the first opening E1 and the height Z2 of the second opening E2 are set to 0.5 mm or more.

The inventors of the present application found a relationship between the layer thickness of a developer 99 (see FIG. 17) on the first conveying pole S1 (hereinafter simply referred to as "developer layer thickness") and each of toner scattering, an insufficient image density, and a void.

TABLE 1

| Example | Developer layer thickness (mm) | Tonner scattering | Insufficient image density | Void |
|---|---|---|---|---|
| 1 | 0.45 | C | C | A |
| 2 | 0.53 | C | B | A |
| 3 | 0.6 | B | A | A |
| 4 | 0.72 | B | A | A |
| 5 | 0.86 | A | A | A |
| 6 | 0.95 | A | A | A |
| 7 | 1.05 | A | A | A |
| 8 | 1.2 | A | A | B |
| 9 | 1.35 | A | A | B |
| 10 | 1.52 | A | A | C |

Table 1 shows a relationship between the developer layer thickness (mm) and each of toner scattering, an insufficient image density, and a void.

The developer layer thickness is obtained according to the following method.

First, the cover unit is detached from the housing so as to open the upper part of the developing roller. Subsequently, a nonmagnetic metal plate is placed just above the first conveying pole S1 when seen from the rotation center of the developing roller.

Figure 17:
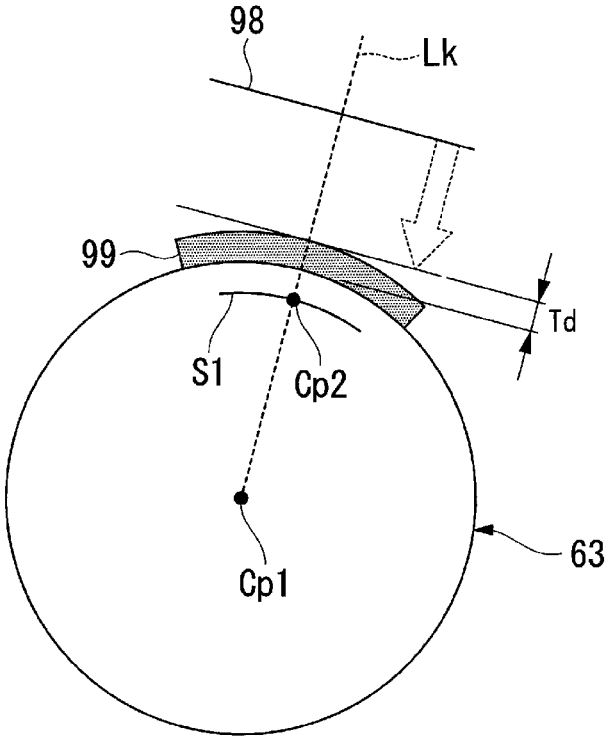
FIG. 17 is an explanatory diagram to explain a method for calculating a layer thickness of a developer.

FIG. 17 is an explanatory diagram to explain a method for calculating the developer layer thickness.

As shown in FIG. 17, an extension line Lk (an imaginary straight line) passing through the rotation center Cp1 of the developing roller 63 and the center Cp2 of the first conveying pole S1 is defined. The nonmagnetic metal plate 98 is placed so as to extend vertically to the extension line Lk on the extension line Lk. The nonmagnetic metal plate 98 is gradually brought closer to the developing roller 63 while rotating the developing roller 63 at a peripheral speed of about 10 mm/s, and the developer layer thickness Td is calculated when the adhesion of the toner to the nonmagnetic metal plate 98 is found.

The spacing between the developing roller and the photoconductive body when the developing roller does not carry the developer was set to 0.35 mm.

Toner scattering was evaluated based on the number of printed sheets until a defect occurs. The number of printed sheets until the defect occurs is the number of printed sheets until image contamination occurs due to the progress of contamination of the charger with the toner by performing a paper feed test under high-temperature and high-humidity conditions (temperature: 30° C., humidity: 85%) which are disadvantaged to toner scattering. In Table 1, with respect to the toner scattering, the case where the number of printed sheets until a defect occurs was 120,000 or more was graded "A", the case where the number of printed sheets until a detect occurs was 80,000 or more and less than 120,000 was graded "B", and the case where the number of printed sheets until a defect occurs was less than 80,000 was graded "C".

As a measurement device for the image density, Spectro Eye (product name) manufactured by X-Rite, Inc. was used. In Table 1, with respect to the insufficient image density, the case where the density of a solid black image was 1.35 or more was graded "A", the case where the density of a solid black image was 1.20 or more and less than 1.35 was graded "B", and the case where the density of a solid black image was less than 1.20 was graded "C".

With respect to the void, sensory evaluation was performed by visual determination. In Table 1, the case where a void was not generated in an image was graded "A", the case where a slight void was generated was graded "B", and the case where an apparent void was generated was graded "C".

As shown in Table 1, the case where the developer layer thickness was 0.6 mm or more was graded "B" or "A" (the number of printed sheets until the occurrence of a defect was 80,000 or more) with respect to the evaluation for the toner scattering, and it was evaluated that toner scattering can be suppressed. The case where the developer layer thickness was 0.85 mm or more was graded "A" (the number of printed sheets until the occurrence of a defect was 120,000 or more) with respect to the evaluation for the toner scattering, and it was evaluated that toner scattering can be more effectively suppressed.

Further, the case where the developer layer thickness was 0.6 mm or more was graded "A" with respect to the evaluation for the image density, and it was evaluated that an insufficient image density can be suppressed.

Further, the case where the developer layer thickness was 1.4 mm or less was graded "B" or "A" with respect to the evaluation for the void, and it was evaluated that the generation of an apparent void can be suppressed. Further, the case where the developer layer thickness was 1.1 mm or less was graded "A" with respect to the evaluation for the void, and it was evaluated that the generation of a void can be suppressed.

As a result, it was evaluated that when the developer layer thickness was 0.85 mm or more and 1.1 mm or less, toner scattering, an insufficient image density, and a void can be effectively suppressed.

According to the image forming apparatus of at least one embodiment described above, toner scattering outside the developing device can be suppressed.

Some functions of the image forming apparatus according to the embodiment described above may be implemented by a computer. In such a case, those functions may be implemented as follows. A program for implementing this function is recorded in a computer-readable recording medium, and a computer system is made to read and execute the program recorded in this recording medium. The "computer system" as used herein includes hardware such as OS and peripherals. Further, the "computer-readable recording medium" refers to a portable medium such as a flexible disk, a magneto-optical disk, an ROM, or a CD-ROM, or a memory device such as a hard disk embedded in the computer system. In addition, the "computer-readable recording medium" may include a computer-readable recording medium for dynamically holding a program for a short time as in a communication line when the program is transmitted via a network such as the Internet or a communication circuit such as a telephone circuit and a computer-readable recording medium for holding a program for a predetermined time as in a volatile memory inside the computer system to serve as a server or a client when the program is transmitted. Also, the above-mentioned program may be a program for implementing some of the above-mentioned functions. Further, the above-mentioned program may be a program which can implement the above-mentioned functions in combination with a program already recorded in the computer system.

While several embodiments of the invention have been described, these embodiments are presented by way of example only and are not intended to limit the scope of the invention. The embodiments described herein can be embodied in various other forms, and various omissions, substitutions, and changes can be made without departing from the gist of the invention. The embodiments and modifications thereof are included in the scope and gist of the invention and also included in the invention described in the claims and in the scope of their equivalents.

What is claimed is:

1. A developing device comprising:

a housing including a developer chamber and an opening;

a developing roller disposed in the developer chamber, such that a part of the developing roller in a rotational direction thereof is exposed to an outside of the opening, wherein the developer roller includes a shaft, a sleeve rotatable around the shaft, and a magnetic element between the shaft and the sleeve, the magnetic element having a magnetic polarity opposite to a magnetic polarity of a developer and being disposed at an entrance rotational position of the developer roller at which a sleeve region of the sleeve goes into the developer chamber from the outside of the opening;

a blade positioned near a surface of the sleeve to regulate a thickness of the developer on the surface of the sleeve, wherein the thickness of the developer regulated on the sleeve region at the entrance rotational position by the blade is equal to or greater than 0.6 mm and equal to or less than 1.4 mm; and a gap forming member positioned in the developer chamber between an internal wall of the developer chamber and the sleeve, wherein the gap forming member has a first surface that faces the sleeve and a second surface that is opposite to the first surface and faces the internal wall of the developer chamber, the gap forming member forming a first gap between the first surface and the sleeve and a second gap between the second surface and the internal wall of the developer chamber, such that a circulation of an air flow passing through the first and second gaps is generated as the sleeve rotates.

2. A developing device comprising:

a housing including a developer chamber and an opening;

a developing roller disposed in the developer chamber, such that a part of the developing roller in a rotational direction thereof is exposed to an outside of the opening, wherein the developer roller includes a shaft, a sleeve rotatable around the shaft, and a magnetic element between the shaft and the sleeve, the magnetic element having a magnetic polarity opposite to a magnetic polarity of a developer and being disposed at an entrance rotational position of the developer roller at which a sleeve region of the sleeve goes into the developer chamber from the outside of the opening; and a gap forming member positioned in the developer chamber between an internal wall of the developer chamber and the sleeve, wherein the gap forming member has a first surface that faces the sleeve and a second surface that is opposite to the first surface and faces the internal wall of the developer chamber, the gap forming member forming a first gap between the first surface and the sleeve and a second gap between the second surface and the internal wall of the developer chamber, such that a circulation of an air flow passing through the first and second gaps is generated as the sleeve rotates.

3. An image forming apparatus comprising:

a developing device; and a photoconductive drum on which a toner image is formed over an electrostatic image with toner supplied from the developing device, the developing device including:

a housing including a developer chamber and an opening;

a developing roller disposed in the developer chamber, such that a part of the developing roller in a rotational direction thereof is exposed to an outside of the opening, wherein the developer roller includes a shaft, a sleeve rotatable around the shaft, and a magnetic element between the shaft and the sleeve, the magnetic element having a magnetic polarity opposite to a magnetic polarity of a developer and being disposed at an entrance rotational position of the developer roller at which a sleeve region of the sleeve goes into the developer chamber from the outside of the opening;

a blade positioned near a surface of the sleeve to regulate a thickness of the developer on the surface of the sleeve, wherein the thickness of the developer regulated on the sleeve region at the entrance rotational position by the blade is equal to or greater than 0.6 mm and equal to or less than 1.4 mm; and a gap forming member positioned in the developer chamber between an internal wall of the developer chamber and the sleeve, wherein the gap forming member has a first surface that faces the sleeve and a second surface that is opposite to the first surface and faces the internal wall of the developer chamber, the gap forming member forming a first gap between the first surface and the sleeve and a second gap between the second surface and the internal wall of the developer chamber, such that a circulation of an air flow passing through the first and second gaps is generated as the sleeve rotates.

4. The developing device according to claim 1, wherein the thickness of the developer regulated on the sleeve region at the entrance rotational position is equal to or greater than 0.85 mm and equal to or less than 1.4 mm.

5. The developing device according to claim 1, wherein the thickness of the developer regulated on the sleeve region at the entrance rotational position is equal to or greater than 0.85 mm and equal to or less than 1.1 mm.

6. The developing device according to claim 1, wherein the gap forming member at least partially faces the magnetic element.

7. The developing device according to claim 1, further comprising:

a shield member positioned between the gap forming member and the sleeve and contacting the surface of the sleeve.

8. The developing device according to claim 7, wherein the shield member is attached to the gap forming member.

9. The developing device according to claim 7, wherein the shield member is formed of a porous elastic material.

10. The developing device according to claim 1, wherein the blade is positioned at an exit rotational position of the developer roller at which a sleeve region of the sleeve goes out of the developer chamber to the outside of the opening.

11. The developing device according to claim 1, wherein an edge of the housing defining the opening and facing the magnetic element extends towards the surface of the sleeve, an angle between an extension line of the edge of the housing and a normal line of the developing roller crossing the extension line at the surface of the sleeve being equal to or greater than 30 and equal to or less than 90.

12. The developing device according to claim 2, wherein the gap forming member at least partially faces the magnetic element.

13. The developing device according to claim 12, further comprising:

a shield member positioned between the gap forming member and the sleeve and contacting the surface of the sleeve.

14. The developing device according to claim 13, wherein the shield member is attached to the gap forming member.

15. The developing device according to claim 2, further comprising:

a blade positioned at an exit rotational position of the developer roller at which a sleeve region of the sleeve goes out of the developer chamber to the outside of the opening.

16. The image forming apparatus according to claim 3, wherein a plurality of pairs of the developing device and the photoconductive drum is provided.

17. The image forming apparatus according to claim 3, wherein the thickness of the developer regulated on the sleeve region at the entrance rotational position is equal to or greater than 0.85 mm and equal to or less than 1.4 mm.

18. The image forming apparatus according to claim 3, wherein the thickness of the developer regulated on the sleeve region at the entrance rotational position is equal to or greater than 0.85 mm and equal to or less than 1.1 mm.

19. The image forming apparatus according to claim 3, wherein the blade is positioned at an exit rotational position of the developer roller at which a sleeve region of the sleeve goes out of the developer chamber to the outside of the opening.

* * * * *